US008571877B2

(12) United States Patent
Engdegard et al.

(10) Patent No.: US 8,571,877 B2
(45) Date of Patent: Oct. 29, 2013

(54) APPARATUS FOR PROVIDING AN UPMIX SIGNAL REPRESENTATION ON THE BASIS OF THE DOWNMIX SIGNAL REPRESENTATION, APPARATUS FOR PROVIDING A BITSTREAM REPRESENTING A MULTI-CHANNEL AUDIO SIGNAL, METHODS, COMPUTER PROGRAMS AND BITSTREAM REPRESENTING A MULTI-CHANNEL AUDIO SIGNAL USING A LINEAR COMBINATION PARAMETER

(75) Inventors: Jonas Engdegard, Stockholm (SE); Heiko Purnhagen, Sundbyberg (SE); Juergen Herre, Buckenhof (DE); Cornelia Falch, Rum (AT); Oliver Hellmuth, Erlangen (DE); Leon Terentiv, Erlangen (DE)

(73) Assignees: Fraunhofer-Gesellschaft zur Foerderung der Angewandten Forschung e.V., Munich (DE); Dolby International AB, Stockholm (SE)

( * ) Notice: Subject to any disclaimer, the term of this patent is extended or adjusted under 35 U.S.C. 154(b) by 0 days.

(21) Appl. No.: 13/475,084

(22) Filed: May 18, 2012

(65) Prior Publication Data

US 2012/0259643 A1 Oct. 11, 2012

Related U.S. Application Data

(63) Continuation of application No. PCT/EP2010/067550, filed on Nov. 16, 2010.

(60) Provisional application No. 61/369,261, filed on Jul. 30, 2010, provisional application No. 61/263,047, filed on Nov. 20, 2009.

(30) Foreign Application Priority Data

Jul. 30, 2010 (EP) ..... 10171452

(51) Int. Cl.
*G10L 19/00* (2013.01)

(52) U.S. Cl.
USPC ..... 704/501; 704/200; 704/200.1

(58) Field of Classification Search
USPC ..... 704/200–203, 500–504
See application file for complete search history.

(56) References Cited

U.S. PATENT DOCUMENTS 8,204,756 B2 * 6/2012 Kim et al. ..... 704/501
2006/0239473 A1 10/2006 Kjorling et al.

(Continued)

FOREIGN PATENT DOCUMENTS

CN 101411214 A 4/2009
CN 101529504 A 9/2009
WO 2008/100067 A1 8/2008

OTHER PUBLICATIONS

Official Communication issued in International Patent Application No. PCT/EP2010/067550, mailed on Mar. 7, 2011.

(Continued)

*Primary Examiner* — Douglas Godbold
(74) *Attorney, Agent, or Firm* — Keating & Bennett, LLP

(57) ABSTRACT

An apparatus for providing an upmix signal representation on the basis of a downmix signal representation and an object-related parametric information, which are included in a bitstream representation of an audio content, in independence on a user-specified rendering matrix, the apparatus has a distortion limiter configured to obtain a modified rendering matrix using a linear combination of a user-specified rendering matrix in a target rendering matrix in dependence on a linear combination parameter. The apparatus also has a signal processor configured to obtain the upmix signal representation on the basis of the downmix signal representation and the object-related parametric information using the modified rendering matrix. The apparatus is also configured to evaluate a bitstream element representing the linear combination parameter in order to obtain the linear combination parameter.

21 Claims, 16 Drawing Sheets

(56) References Cited

U.S. PATENT DOCUMENTS

| | | | | |
|---|---|---|---|---|
| 2009/0110203 | A1 | 4/2009 | Taleb | |
| 2009/0125314 | A1* | 5/2009 | Hellmuth et al. | 704/501 |
| 2009/0144063 | A1* | 6/2009 | Beack et al. | 704/500 |
| 2009/0228285 | A1* | 9/2009 | Schnell et al. | 704/500 |
| 2009/0326958 | A1* | 12/2009 | Kim et al. | 704/500 |
| 2010/0010821 | A1* | 1/2010 | Oh et al. | 704/500 |
| 2010/0014680 | A1* | 1/2010 | Oh et al. | 381/23 |
| 2010/0014692 | A1* | 1/2010 | Schreiner et al. | 381/119 |
| 2010/0076772 | A1* | 3/2010 | Kim et al. | 704/500 |
| 2010/0114582 | A1* | 5/2010 | Beack et al. | 704/500 |
| 2010/0119073 | A1* | 5/2010 | Oh et al. | 381/28 |
| 2011/0013790 | A1 | 1/2011 | Hilpert et al. | |
| 2011/0022402 | A1* | 1/2011 | Engdegard et al. | 704/501 |

OTHER PUBLICATIONS

Faller et al., "Binaural Cue Coding Part II: Schemes and Applications," IEEE Transactions on Speech and Audio Processing, vol. 11, No. 6, Nov. 2003, pp. 1-12.

Faller, "Parametric Joint-Coding of Audio Sources," AES 120th Convention, Convention Paper 6752, May 20-23, 2006, pp. 1-12, Paris, France.

Herre et al., "From SAC to SAOC—Recent Developments in Parametric Coding of Spatial Audio," AES 22nd UK Conference, Illusions in Sound, Apr. 2007, pp. 12-1 to 12-8.

Engdegard et al., "Spatial Audio Object Coding (SAOC)—The Upcoming MPEG Standard on Parametric Object Based Audio Coding," AES 124th Convention, Convention Paper 7377, May 17-20, 2008, pp. 1-15, Amsterdam, The Netherlands.

"Information Technologies—MPEG Audio Technologies—Part 2: Spatial Audio Object Coding (SAOC)," ISO/IEC JTC1/SC 29/WG 11, Jul. 25, 2008,138 pages.

EBU Technical recommendation: "MUSHRA-EBU Method for Subjective Listening Tests of Intermediate Audio Quality", Doc. B/AIM022, Oct. 1999.

ISO/IEC JTC1/SC29/WG11 (MPEG), Document N10843, "Study on ISO/IEC 23003-2:200x Spatial Audio Object Coding (SAOC)", 89th MPEG Meeting, London, UK, Jul. 2009.

Herre et al., "MPEG Surround—The ISO/MPEG Standard for Efficient and Compatible Multichannel Audio Coding," J. Audio Eng. Soc., vol. 56, No. 11, Nov. 2008, pp. 932-955.

Juergen Herre et al., "Methods, Apparatus, and Computer Programs for Distortion Avoiding Audio Signal Processing," U.S. Appl. No. 61/173,456, filed Apr. 28, 2009.

Official Communication issued in corresponding Chinese Patent Application No. 201080062050.2, mailed on Apr. 11, 2013.

Official Communication issued in corresponding Taiwanese Patent Application No. 10220559480, mailed on May 2, 2013.

* cited by examiner

310

Syntax of SAOCSpecificConfig()

| Syntax | No. of bits | Mnemonic |
|---|---|---|
| SAOCSpecificConfig() | | |
| { | | |
| Sampling Frequency Configuration; | | |
| Low Delay Mode Configuration; | | |
| Frequency Resolution Configuration; | | |
| Frame Length Configuration; | | |
| Object Number Configuration: | | |
| Object Relationship Configuration: | | |
| Absolute Energy Transmission Configuration; | | |
| Downmix Channel Number Configuration; | | |
| Additional Configuration Information; | | |
| bsDdgFlag; | 1 | |
| **bsDcuFlag;** | 1 | uimsbf |
| if ( bsDcuFlag == 1 ) { | | |
| **bsDcuMandatory;** | 1 | uimsbf |
| **bsDcuDynamic;** | 1 | uimsbf |
| if ( bsDcuDynamic == 0) { | | |
| **bsDcuMode;** | 1 | uimsbf |
| **bsDcuParam** | 4 | uimsbf |
| } | | |
| } else { | | |
| bsDcuMandatory = 0; | | |
| bsDcuDynamic = 0; | | |
| bsDcuMode = 0 ; | | |
| bsDcuParam = 0; | | |
| } | | |
| ByteAlign(); | | |
| SAOCExtensionConfig(); | | |
| } | | |

FIGURE 3B

| Syntax | No. of bits | Mne-monic |
|---|---|---|
| SAOCFrame { | | |
| encoded object level difference values (OLD); (band-wise and per audio object) | variable | |
| encoded absolute energy values (optional) (NRG); (band-wise) | variable | |
| encoded inter-object correlation values (IOC); (band-wise and for combinations of audio objects) | variable | |
| encoded downmix-gain values (DMG) (per audio object) | variable | |
| encoded downmix channel level differences (DCLD) (per audio object) | variable | |
| encoded post-processing downmix gain values (optional) (PDG) | variable | |
| if ( bsDcuFlag == 1 ) && ( bsDcuDynamic == 1 ) { | | |
| if ( bsIndependencyFlag == 1 ) { | | |
| bsDcuDynamicUpdate == 1; | | |
| } else { | | |
| **bsDcuDynamicUpdate;** | 1 | **uimsbf** |
| } | | |
| if ( bsDcuDynamicUpdate == 1 ) { | | |
| **bsDcuMode;** | 1 | **uimsbf** |
| **bsDcuParam;** | 4 | **uimsbf** |
| } | | |
| } | | |
| ByteAlign(); | | |
| SAOCExtensionFrame(); | | |
| } | | |

FIGURE 3C bsDcuMode

| bsDcuMode | Meaning |
|---|---|
| 0 | downmix-similar target matrix |
| 1 | best effort target matrix |

FIGURE 3D

Table 39 - bsDcuParam parameters quantization table

| | | | | | | | | |
|---|---|---|---|---|---|---|---|---|
| idx | 0 | 1 | 2 | 3 | 4 | 5 | 6 | 7 |
| DcuParam[idx] | 0.00 | 0.05 | 0.10 | 0.15 | 0.20 | 0.25 | 0.30 | 0.35 |
| idx | 8 | 9 | 10 | 11 | 12 | 13 | 14 | 15 |
| DcuParam[idx] | 0.40 | 0.45 | 0.50 | 0.60 | 0.70 | 0.80 | 0.90 | 1.00 |

FIGURE 3E

Table 4 - Syntax of SAOCSpecificConfig()

| Syntax | No. of bits | Mnemonic |
|---|---|---|
| SAOCSpecificConfig() | | |
| { | | |
| SAOC Configuration Information; | | |
| **bsPdgFlag;** | 1 | uimsbf |
| **bsDcuFlag;** | 1 | uimsbf |
| if ( bsDcuFlag == 1 ) { | | |
| **bsDcuMode;** | 1 | uimsbf |
| **bsDcuParam;** | 4 | uimsbf |
| } | | |
| else { | | |
| bsDcuMode = 0 ; | | |
| bsDcuParam = 6; | | |
| } | | |
| } | | |
| ByteAlign(); | | |
| SAOCExtensionConfig(); | | |
| } | | |

510

FIGURE 5A bsDcuParam parameters quantization table

| | | | | | | | | |
|---|---|---|---|---|---|---|---|---|
| idx | 0 | 1 | 2 | 3 | 4 | 5 | 6 | 7 |
| DcuParam[idx] | 0.00 | 0.05 | 0.10 | 0.15 | 0.20 | 0.25 | 0.30 | 0.35 |
| idx | 8 | 9 | 10 | 11 | 12 | 13 | 14 | 15 |
| DcuParam[idx] | 0.40 | 0.45 | 0.50 | 0.60 | 0.70 | 0.80 | 0.90 | 1.00 |

FIGURE 5B

Listening test conditions

| Coder name | Description |
|---|---|
| "_DMX" | trivial downmix-similar rendering signal of the regular SAOC decoder |
| "_noLim" | output of the regular (unprocessed by the DCU) SAOC decoder |
| "_RLim" | output of the SAOC decoder with DCU using the "downmix-similar rendering" |
| "_RLimBE" | output of the SAOC decoder with DCU using the "best effort rendering" |

FIGURE 6A

Audio items of the listening test

| Listening items | Description | Duration |
|---|---|---|
| "BlackCoffee" | Soft brass section within the sound mix | 7 seconds |
| "Fanta4" | Strong drum sound within the sound mix | 7 seconds |
| "LovePop" | Strong vocal sound and soft music | 7 seconds |
| "Audition" | Soft string section within the sound mix | 13 seconds |

FIGURE 6B

Test downmix/rendering conditions
for stereo-to-stereo SAOC decoding scenario

| Listening items | Obj | Audio object description | Downmix (L/R) | | Rendering (L/R) | |
|---|---|---|---|---|---|---|
| "BlackCoffee" | 1 | Brass 1 | 1.0 | 0.6 | 0.0001 | 0.0001 |
| | 2 | Brass 2 | 0.5 | 1.0 | 0.0001 | 0.0001 |
| | 3 | Organ | 0.5778 | 0.8162 | 1.2628 | 0.6329 |
| | 4 | Drums and bass | 0.8162 | 0.5778 | 0.9988 | 0.9988 |
| | 5 | Percussion | 0.4481 | 0.8940 | 0.9988 | 0.9988 |
| "VoiceOverMusic" | 1 | Background music (L) | 1.0 | 0.0 | 0.01 | 0.0 |
| | 2 | Bachground music (R) | 0.0 | 1.0 | 0.0 | 0.01 |
| | 3 | Vocal | 0.7071 | 0.7071 | 0.7071 | 0.7071 |
| "LovePop" | 1 | Drums | 0.7071 | 0.7071 | 0.4462 | 0.4462 |
| | 2 | Bass | 0.7071 | 0.7071 | 0.4462 | 0.4462 |
| | 3 | Electric guitar | 0.7071 | 0.7071 | 0.5150 | 0.3646 |
| | 4 | Acoustic guitar | 0.7071 | 0.7071 | 0.1105 | 0.6213 |
| | 5 | Strings | 0.7071 | 0.7071 | 0.0 | 0.0 |
| "Audition" | 1 | Background vocals | 2.7335 | 0.6866 | 0.4860 | 0.1221 |
| | 2 | Bass | 1.9929 | 1.9929 | 0.3543 | 0.3543 |
| | 3 | Drums reverb | 1.9929 | 1.9929 | 0.3543 | 0.3543 |
| | 4 | Kick drum | 1.9929 | 1.9929 | 0.3543 | 0.3543 |
| | 5 | Lead guitar | 1.0425 | 2.6185 | 0.1853 | 0.4656 |
| | 6 | Lead vocals double | 0.8498 | 2.6872 | 2.6873 | 8.4978 |
| | 7 | Lead vocals | 1.9929 | 1.9929 | 6.3022 | 6.3022 |
| | 8 | Drums overhead | 2.3003 | 1.6285 | 0.4090 | 0.2895 |
| | 9 | Rhythm guitars | 2.5197 | 1.2628 | 0.4480 | 0.2245 |
| | 10 | Slap echo | 2.7749 | 0.4934 | 8.7749 | 1.5604 |
| | 11 | Snare drum | 1.6285 | 2.3003 | 0.2895 | 0.4090 |
| | 12 | TomTom | 0.6866 | 2.7335 | 0.1221 | 0.4860 |

FIGURE 6C

DCU listening test results for stereo-to-stereo SAOC decoding scenarios

MPEG SAOC system overview

SEPARATE DECODER AND MIXER

INTEGRATED DECODER AND MIXER

APPARATUS FOR PROVIDING AN UPMIX SIGNAL REPRESENTATION ON THE BASIS OF THE DOWNMIX SIGNAL REPRESENTATION, APPARATUS FOR PROVIDING A BITSTREAM REPRESENTING A MULTI-CHANNEL AUDIO SIGNAL, METHODS, COMPUTER PROGRAMS AND BITSTREAM REPRESENTING A MULTI-CHANNEL AUDIO SIGNAL USING A LINEAR COMBINATION PARAMETER

CROSS-REFERENCE TO RELATED APPLICATIONS

This application is a continuation of copending International Application No. PCT/EP2010/067550, filed Nov. 16, 2010, which is incorporated herein by reference in its entirety, and additionally claims priority from European Application No. EP 10171452.5, filed Jul. 30, 2010, and U.S. Applications Nos. U.S. 61/263,047, filed Nov. 20, 2009 and U.S. 61/369,261, filed Jul. 30, 2010, all of which are incorporated herein by reference in their entirety.

Embodiments according to the invention are related to an apparatus for providing an upmix signal representation on the basis of a downmix signal representation and an object-related parametric information, which are included in a bitstream representation of an audio content, and in dependence on a user-specified rendering matrix.

Other embodiments according to the invention are related to an apparatus for providing a bitstream representing a multi-channel audio signal.

Other embodiments according to the invention are related to a method for providing an upmix signal representation on the basis of a downmix signal representation and an object-related parametric information which are included in a bitstream representation of the audio content, and in dependence on a user-specified rendering matrix.

Other embodiments according to the invention are related to a method for providing a bitstream representing a multi-channel audio signal.

Other embodiments according to the invention are related to a computer program performing one of said methods.

Another embodiment according to the invention is related to a bitstream representing a multi-channel audio signal.

BACKGROUND OF THE INVENTION

In the art of audio processing, audio transmission and audio storage there is an increasing desire to handle multi-channel contents in order to improve the hearing impression. Usage of a multi-channel audio content brings along significant improvements for the user. For example, a 3-dimensional hearing impression can be obtained, which brings along an improved user satisfaction in entertainment applications. However, multi-channel audio contents are also useful in professional environments, for example, telephone conferencing applications, because the speaker intelligibility can be improved by using a multi-channel audio playback.

However, it is also desirable to have a good trade-off between audio quality and bitrate requirements in order to avoid excessive resource consumption in low-cost or professional multi-channel applications.

Parametric techniques for the bitrate-efficient transmission and/or storage of audio scenes containing multiple audio objects have recently been proposed. For example, a binaural cue coding, which is described, for example, in reference [1], and a parametric joint-coding of audio sources, which is described, for example, in reference [2], have been proposed. Also, an MPEG spatial audio object coding (SAOC) has been proposed, which is described, for example, in references [3] and [4]. MPEG spatial audio object coding is currently under standardization, and described in non-pre-published reference [5].

These techniques aim at perceptually reconstructing the desired output scene rather than by a wave form match.

However, in combination with user interactivity at the receiving side, such techniques may lead to a low audio quality of the output audio signals if extreme object rendering is performed. This is described, for example, in reference [6].

In the following, such systems will be described, and it should be noted that the basic concepts also apply to the embodiments of the invention.

FIG. 8 shows a system overview of such a system (here: MPEG SAOC). The MPEG SAOC system 800 shown in FIG. 8 comprises an SAOC encoder 810 and an SAOC decoder 820. The SAOC encoder 810 receives a plurality of object signals $x_1$ to $x_N$, which may be represented, for example, as time-domain signals or as time-frequency-domain signals (for example, in the form of a set of transform coefficients of a Fourier-type transform, or in the form of QMF subband signals). The SAOC encoder 810 typically also receives downmix coefficients $d_1$ to $d_N$, which are associated with the object signals $x_1$ to $x_N$. Separate sets of downmix coefficients may be available for each channel of the downmix signal. The SAOC encoder 810 is typically configured to obtain a channel of the downmix signal by combining the object signals $x_1$ to $x_N$ in accordance with the associated downmix coefficients $d_1$ to $d_N$. Typically, there are less downmix channels than object signals $x_1$ to $x_N$. In order to allow (at least approximately) for a separation (or separate treatment) of the object signals at the side of the SAOC decoder 820, the SAOC encoder 810 provides both the one or more downmix signals (designated as downmix channels) 812 and a side information 814. The side information 814 describes characteristics of the object signals $x_1$ to $x_N$, in order to allow for a decoder-sided object-specific processing.

The SAOC decoder 820 is configured to receive both the one or more downmix signals 812 and the side information 814. Also, the SAOC decoder 820 is typically configured to receive a user interaction information and/or a user control information 822, which describes a desired rendering setup. For example, the user interaction information/user control information 822 may describe a speaker setup and the desired spatial placement of the objects which provide the object signals $x_1$ to $x_N$.

The SAOC decoder 820 is configured to provide, for example, a plurality of decoded upmix channel signals $\hat{y}_1$ to $\hat{y}_M$. The upmix channel signals may for example be associated with individual speakers of a multi-speaker rendering arrangement. The SAOC decoder 820 may, for example, comprise an object separator 820*a*, which is configured to reconstruct, at least approximately, the object signals $x_1$ to $x_N$ on the basis of the one or more downmix signals 812 and the side information 814, thereby obtaining reconstructed object signals 820*b*. However, the reconstructed object signals 820*b* may deviate somewhat from the original object signals $x_1$ to $x_N$, for example, because the side information 814 is not quite sufficient for a perfect reconstruction due to the bitrate constraints. The SAOC decoder 820 may further comprise a mixer 820*c*, which may be configured to receive the reconstructed object signals 820*b* and the user interaction information/user control information 822, and to provide, on the basis thereof, the upmix channel signals $\hat{y}_1$ to $\hat{y}_M$. The mixer 820 may be configured to use the user interaction information/ user control information 822 to determine the contribution of the individual reconstructed object signals 820*b* to the upmix channel signals $\hat{y}_1$ to $\hat{y}_M$. The user interaction information/user control information 822 may, for example, comprise rendering parameters (also designated as rendering coefficients), which determine the contribution of the individual reconstructed object signals 822 to the upmix channel signals $\hat{y}_1$ to $\hat{y}_M$.

However, it should be noted that in many embodiments, the object separation, which is indicated by the object separator 820*a* in FIG. 8, and the mixing, which is indicated by the mixer 820*c* in FIG. 8, are performed in single step. For this purpose, overall parameters may be computed which describe a direct mapping of the one or more downmix signals 812 onto the upmix channel signals $\hat{y}_1$ to $\hat{y}_M$. These parameters may be computed on the basis of the side information and the user interaction information/user control information 820.

Taking reference now to FIGS. 9*a*, 9*b* and 9*c*, different apparatus for obtaining an upmix signal representation on the basis of a downmix signal representation and object-related side information will be described. FIG. 9*a* shows a block schematic diagram of a MPEG SAOC system 900 comprising an SAOC decoder 920. The SAOC decoder 920 comprises, as separate functional blocks, an object decoder 922 and a mixer/renderer 926. The object decoder 922 provides a plurality of reconstructed object signals 924 in dependence on the downmix signal representation (for example, in the form of one or more downmix signals represented in the time domain or in the time-frequency-domain) and object-related side information (for example, in the form of object meta data). The mixer/renderer 924 receives the reconstructed object signals 924 associated with a plurality of N objects and provides, on the basis thereof, one or more upmix channel signals 928. In the SAOC decoder 920, the extraction of the object signals 924 is performed separately from the mixing/rendering which allows for a separation of the object decoding functionality from the mixing/rendering functionality but brings along a relatively high computational complexity.

Taking reference now to FIG. 9*b*, another MPEG SAOC system 930 will be briefly discussed, which comprises an SAOC decoder 950. The SAOC decoder 950 provides a plurality of upmix channel signals 958 in dependence on a downmix signal representation (for example, in the form of one or more downmix signals) and an object-related side information (for example, in the form of object meta data). The SAOC decoder 950 comprises a combined object decoder and mixer/renderer, which is configured to obtain the upmix channel signals 958 in a joint mixing process without a separation of the object decoding and the mixing/rendering, wherein the parameters for said joint upmix process are dependent both on the object-related side information and the rendering information. The joint upmix process depends also on the downmix information, which is considered to be part of the object-related side information.

To summarize the above, the provision of the upmix channel signals 928, 958 can be performed in a one step process or a two step process.

Taking reference now to FIG. 9*c*, an MPEG SAOC system 960 will be described. The SAOC system 960 comprises an SAOC to MPEG Surround transcoder 980, rather than an SAOC decoder.

The SAOC to MPEG Surround transcoder comprises a side information transcoder 982, which is configured to receive the object-related side information (for example, in the form of object meta data) and, optionally, information on the one or more downmix signals and the rendering information. The side information transcoder is also configured to provide an MPEG Surround side information (for example, in the form of an MPEG Surround bitstream) on the basis of a received data. Accordingly, the side information transcoder 982 is configured to transform an object-related (parametric) side information, which is relieved from the object encoder, into a channel-related (parametric) side information, taking into consideration the rendering information and, optionally, the information about the content of the one or more downmix signals.

Optionally, the SAOC to MPEG Surround transcoder 980 may be configured to manipulate the one or more downmix signals, described, for example, by the downmix signal representation, to obtain a manipulated downmix signal representation 988. However, the downmix signal manipulator 986 may be omitted, such that the output downmix signal representation 988 of the SAOC to MPEG Surround transcoder 980 is identical to the input downmix signal representation of the SAOC to MPEG Surround transcoder. The downmix signal manipulator 986 may, for example, be used if the channel-related MPEG Surround side information 984 would not allow to provide a desired hearing impression on the basis of the input downmix signal representation of the SAOC to MPEG Surround transcoder 980, which may be the case in some rendering constellations.

Accordingly, the SAOC to MPEG Surround transcoder 980 provides the downmix signal representation 988 and the MPEG Surround bitstream 984 such that a plurality of upmix channel signals, which represent the audio objects in accordance with the rendering information input to the SAOC to MPEG Surround transcoder 980 can be generated using an MPEG Surround decoder which receives the MPEG Surround bitstream 984 and the downmix signal representation 988.

To summarize the above, different concepts for decoding SAOC-encoded audio signals can be used. In some cases, a SAOC decoder is used, which provides upmix channel signals (for example, upmix channel signals 928, 958) in dependence on the downmix signal representation and the object-related parametric side information. Examples for this concept can be seen in FIGS. 9*a* and 9*b*. Alternatively, the SAOC-encoded audio information may be transcoded to obtain a downmix signal representation (for example, a downmix signal representation 988) and a channel-related side information (for example, the channel-related MPEG Surround bitstream 984), which can be used by an MPEG Surround decoder to provide the desired upmix channel signals.

In the MPEG SAOC system 800, a system overview of which is given in FIG. 8, the general processing is carried out in a frequency selective way and can be described as follows within each frequency band:

- N input audio object signals $x_1$ to $x_N$ are downmixed as part of the SAOC encoder processing. For a mono downmix, the downmix coefficients are denoted by $d_1$ to $d_N$. In addition, the SAOC encoder 810 extracts side information 814 describing the characteristics of the input audio objects. For MPEG SAOC, the relations of the object powers with respect to each other are the most basic form of such a side information.
- Downmix signal (or signals) 812 and side information 814 are transmitted and/or stored. To this end, the downmix audio signal may be compressed using well-known perceptual audio coders such as MPEG-1 Layer II or III (also known as ".mp3"), MPEG Advanced Audio Coding (AAC), or any other audio coder.
- On the receiving end, the SAOC decoder 820 conceptually tries to restore the original object signal ("object separation") using the transmitted side information 814 (and, naturally, the one or more downmix signals 812). These approximated object signals (also designated as reconstructed object signals 820*b*) are then mixed into a target scene represented by M audio output channels (which may, for example, be represented by the upmix channel signals $\hat{y}_1$ to $\hat{y}_M$) using a rendering matrix. For a mono output, the rendering matrix coefficients are given by $r_1$ to $r_N$ Effectively, the separation of the object signals is rarely executed (or even never executed), since both the separation step (indicated by the object separator 820*a*) and the mixing step (indicated by the mixer 820*c*) are combined into a single transcoding step, which often results in an enormous reduction in computational complexity.

It has been found that such a scheme is tremendously efficient, both in terms of transmission bitrate (it is only needed to transmit a few downmix channels plus some side information instead of N discrete object audio signals or a discrete system) and computational complexity (the processing complexity relates mainly to the number of output channels rather than the number of audio objects). Further advantages for the user on the receiving end include the freedom of choosing a rendering setup of his/her choice (mono, stereo, surround, virtualized headphone playback, and so on) and the feature of user interactivity: the rendering matrix, and thus the output scene, can be set and changed interactively by the user according to will, personal preference or other criteria. For example, it is possible to locate the talkers from one group together in one spatial area to maximize discrimination from other remaining talkers. This interactivity is achieved by providing a decoder user interface:

For each transmitted sound object, its relative level and (for non-mono rendering) spatial position of rendering can be adjusted. This may happen in real-time as the user changes the position of the associated graphical user interface (GUI) sliders (for example: object level=+5 dB, object position=−30 deg).

However, it has been found that the decoder-sided choice of parameters for the provision of the upmix signal representation (e.g. the upmix channel signals $\hat{y}_1$ to $\hat{y}_M$) brings along audible degradations in some cases.

SUMMARY

According to an embodiment, a audio processing apparatus for providing an upmix signal representation on the basis of a downmix signal representation and an object-related parametric information, which are comprised in a bitstream representation of an audio content, and in dependence on a user-specified rendering matrix which defines a desired contribution of a plurality of audio objects to one, two or more output audio channels, may have a distortion limiter configured to acquire a modified rendering matrix using a linear combination of a user-specified rendering matrix and a distortion-free target rendering matrix in dependence on a linear combination parameter; and a signal processor configured to acquire the upmix signal representation on the basis of the downmix signal representation and the object-related parametric information using the modified rendering matrix; wherein the apparatus is configured to evaluate a bitstream element representing the linear combination parameter in order to acquire the linear combination parameter.

According to another embodiment, an apparatus for providing a bitstream representing a multi-channel audio signal may have a downmixer configured to provide a downmix signal on the basis of a plurality of audio object signals; a side information provider configured to provide an object-related parametric side information describing characteristics of the audio object signals and downmix parameters, and a linear combination parameter describing desired contributions of a user-specified rendering matrix and of a target rendering matrix to a modified rendering matrix to be used by an apparatus for providing an upmix signal representation on the basis of the bitstream; and a bitstream formatter configured to provide a bitstream comprising a representation of the downmix signal, of the object-related parametric side information and of the linear combination parameter; wherein the user-specified rendering matrix defines a desired contribution of a plurality of audio objects to one, two or more output audio channels.

According to another embodiment, a, audio processing method for providing an upmix signal representation on the basis of a downmix signal representation and an object-related parametric information, which are comprised in a bitstream representation of an audio content, and in a dependence on a user-specified rendering matrix which defines a desired contribution of a plurality of audio objects to one, two or more output audio channels, may have the steps of evaluating a bitstream element representing a linear combination parameter, in order to acquire the linear combination parameter; acquiring a modified rendering matrix using a linear combination of a user-specified rendering matrix and a distortion-free target rendering matrix in dependence on the linear combination parameter; and acquiring the upmix signal representation on the basis of the downmix signal representation and the object-related parametric information using the modified rendering matrix.

According to another embodiment, a method for providing a bitstream representing a multi-channel audio signal may have the steps of providing a downmix signal on the basis of a plurality of audio object signals; providing an object-related parametric side information describing characteristics of the audio object signals and downmix parameters, and a linear combination parameter describing desired contributions of a user-specified rendering matrix and of a target rendering matrix to a modified rendering matrix; and providing a bitstream comprising a representation of the downmix signal, of the object-related parametric side information and the linear combination parameter; wherein the user-specified rendering matrix defines a desired contribution of a plurality of audio objects to one, two or more output audio channels.

According to another embodiment, a computer program may perform one of the above mentioned methods, when the computer program runs on a computer.

According to another embodiment, a bitstream representing a multi-channel audio signal may have a representation of a downmix signal combining audio signals of a plurality of audio objects; an object-related parametric information describing characteristics of the audio objects; and a linear combination parameter describing desired contributions of a user-specified rendering matrix and of a target rendering matrix to a modified rendering matrix.

An embodiment according to the invention creates an apparatus for providing an upmix signal representation on the basis of a downmix signal representation and an object-related parametric information, which are included in a bitstream representation of an audio content, and in dependence on a user-specified rendering matrix. The apparatus comprises a distortion limiter configured to obtain a modified rendering matrix using a linear combination of a user-specified rendering matrix and a target rendering matrix in dependence on a linear combination parameter. The apparatus also comprises a signal processor configured to obtain the upmix signal representation on the basis of the downmix signal representation and the object-related parametric information using the modified rendering matrix. The apparatus is configured to evaluate a bitstream element representing the linear combination parameter in order to obtain the linear combination parameter.

This embodiment according to the invention is based on the key idea that audible distortions of the upmix signal representation can be reduced or even avoided with low computational complexity by performing a linear combination of a user-specified rendering matrix and the target rendering matrix in dependence on a linear combination parameter, which is extracted from the bitstream representation of the audio content, because a linear combination can be performed efficiently, and because the execution of the demanding task of determining the linear combination parameter can be performed at the side of the audio signal encoder where there is typically more computational power available than at the side of the audio signal decoder (apparatus for providing an upmix signal representation).

Accordingly, the above-discussed concept allows to obtain a modified rendering matrix, which results in reduced audible distortions even for an inappropriate choice of the user-specified rendering matrix, without adding any significant complexity to the apparatus for providing an upmix signal representation. In particular, it may even be unnecessary to modify the signal processor when compared to an apparatus without a distortion limiter, because the modified rendering matrix constitutes an input quantity to the signal processor and merely replaces the user-specified rendering matrix. In addition, the inventive concept brings along the advantage that an audio signal encoder can adjust the distortion limitation scheme, which is applied at the side of the audio signal decoder, in accordance with requirements specified at the encoder side by simply setting the linear combination parameter, which is included in the bitstream representation of the audio content. Accordingly, the audio signal encoder may gradually provide more or less freedom with respect to the choice of the rendering matrix to the user of the decoder (apparatus for providing an upmix signal representation) by appropriately choosing the linear combination parameter. This allows for the adaptation of the audio signal decoder to the user's expectations for a given service, because for some services a user may expect a maximum quality (which implies to reduce the user's possibility to arbitrarily adjust the rendering matrix), while for other services the user may typically expect a maximum degree of freedom (which implies to increase the impact of the user's specified rendering matrix onto the result of the linear combination).

To summarize the above, the inventive concept combines high computational efficiency at the decoder side, which may be particularly important for portable audio decoders, with the possibility of a simple implementation, without bringing along the need to modify the signal processor, and also provides a high degree of control to an audio signal encoder, which may be important to fulfill the user's expectations for different types of audio services. In an embodiment, the distortion limiter is configured to obtain the target rendering matrix such that the target rendering matrix is a distortion-free target rendering matrix. This brings along the possibility to have a playback scenario in which there are no distortions or at least hardly any distortions caused by the choice of the rendering matrix. Also, it has been found that the computation of a distortion-free target rendering matrix can be performed in a very simple manner in some cases. Further, it has been found that a rendering matrix, which is chosen in-between a user-specified rendering matrix and a distortion-free target rendering matrix typically results in a good hearing impression.

In an embodiment, the distortion limiter is configured to obtain the target rendering matrix such that the target rendering matrix is a downmix-similar target rendering matrix. It has been found that the usage of a downmix-similar target rendering matrix brings along a very low or even minimal degree of distortions. Also, such a downmix-similar target rendering matrix can be obtained with very low computational effort, because the downmix-similar target rendering matrix can be obtained by scaling the entries of the downmix matrix with a common scaling factor and adding some additional zero entries.

In an embodiment, the distortion limiter is configured to scale an extended downmix matrix using an energy normalization scalar, to obtain the target rendering matrix, wherein the extended downmix matrix is an extended version of the downmix matrix (a row of which downmix matrix describes contributions of a plurality of audio object signals to the one or more channels of the downmix signal representation), extended by rows of zero elements, such that a number of rows of the extended downmix matrix is identical to a rendering constellation described by the user-specified rendering matrix. Thus, the extended downmix matrix is obtained using a copying of values from the downmix matrix into the extended downmix matrix, an addition of zero matrix entries, and a scalar multiplication of all the matrix elements with the same energy normalization scalar. All of these operations can be performed very efficiently, such that the target rendering matrix can be obtained fast, even in a very simple audio decoder.

In an embodiment, the distortion limiter is configured to obtain the target rendering matrix such that the target rendering matrix is a best-effort target rendering matrix. Even though this approach is computationally somewhat more demanding than the usage of a downmix-similar target rendering matrix, the usage of a best-effort target rendering matrix provides for a better consideration of a user's desired rendering scenario. Using the best-effort target rendering matrix, a user's definition of the desired rendering matrix is taken into consideration when determining the target rendering matrix as far as it is possible without introducing distortions or significant distortions. In particular, the best-effort target rendering matrix takes into consideration the user's desired loudness for a plurality of speakers (or channels of the upmix signal representation). Accordingly, an improved hearing impression may result when using the best-effort target rendering matrix.

In an embodiment, the distortion limiter is configured to obtain the target rendering matrix such that the target rendering matrix depends on a downmix matrix and the user's specified rendering matrix. Accordingly, the target rendering matrix is relatively close to the user's expectations but still provides for a substantially distortion-free audio rendering. Thus, the linear combination parameter determines a trade-off between an approximation of the user's desired rendering and minimization of audible distortions, wherein the consideration of the user-specified rendering matrix for the computation of the target rendering matrix provides for a good satisfaction of the user's desires, even if the linear combination parameter indicates that the target rendering matrix should dominate the linear combination.

In an embodiment, the distortion limiter is configured to compute a matrix comprising channel-individual normalization values for a plurality of output audio channels of the apparatus for providing an upmix signal representation, such that an energy normalization value for a given output channel of the apparatus describes, at least approximately, a ratio between a sum of energy rendering values associated with the given output channel in the user-specified rendering matrix for a plurality of audio objects, and a sum of energy downmix values for the plurality of audio objects. Accordingly, a user's expectation with respect to the loudness of the different output channels of the apparatus can be met to some degree.

In this case the distortion limiter is configured to scale a set of downmix values using an associated channel-individual energy normalization value, to obtain a set of rendering values of the target rendering matrix associated with the given output channel. Accordingly, the relative contribution of a given audio object to an output channel of the apparatus is identical to the relative contribution of the given audio object to the downmix signal representation, which allows to substantially avoid audible distortions which would be caused by a modification of the relative contributions of the audio objects. Accordingly, each of the output channels of the apparatus is substantially undistorted. Nevertheless, the user's expectation with respect to a loudness distribution over a plurality of speakers (or channels of the upmix signal representation) is taken into consideration, even though details where to place which audio object and/or how to change relative intensities of the audio objects with respect to each other are left unconsidered (at least to some degree) in order to avoid distortions which would possibly be caused by an excessively sharp spatial separation of the audio objects or an excessive modification of relative intensities of audio objects.

Thus, evaluating the ratio between a sum of energy rendering values (for example, squares of magnitude rendering values) associated with a given output channel in the user-specified rendering matrix for a plurality of audio objects and a sum of energy downmix values for the plurality of audio objects allows to consider all of the output audio channels, even though the downmix signal representation may comprise of less channels, while still avoiding distortions which would be caused by a spatial redistribution of audio objects or by an excessive change of the relative loudness of the different audio objects.

In an embodiment, the distortion limiter is configured to compute a matrix describing a channel-individual energy normalization for a plurality of output audio channels of the apparatus for providing an upmix signal representation in dependence on the user-specified rendering matrix and a downmix matrix. In this case, the distortion limiter is configured to apply the matrix describing the channel-individual energy normalization to obtain a set of rendering coefficients of the target rendering matrix associated with the given output channel of the apparatus as a linear combination of sets of downmix values (i.e., values describing a scaling applied to the audio signals of different audio objects to obtain a channel of the downmix signal) associated with different channels of the downmix signal representation. Using this concept, a target rendering matrix, which is well-adapted to the desired user-specified rendering matrix, can be obtained even if the downmix signal representation comprises more than one audio channel, while still substantially avoiding distortions. It has been found that the formation of a linear combination of sets of downmix values results in a set of rendering coefficients which typically causes only small audible distortions. Nevertheless, it has been found that it is possible to approximate a user's expectation using such an approach for deriving the target rendering matrix.

In an embodiment, the apparatus is configured to read an index value representing the linear combination parameter from the bitstream representation of the audio content, and to map the index value onto the linear combination parameter using a parameter quantization table. It has been found that this is a particularly computationally efficient concept for deriving the linear combination parameter. It has also been found that this approach brings along a better trade-off between user's satisfaction and computational complexity when compared to other possible concepts in which complicated computations, rather than the evaluation of a 1-dimensional mapping table, are performed.

In an embodiment, the quantization table describes a non-uniform quantization, wherein smaller values of the linear combination parameter, which describe a stronger contribution of the user-specified rendering matrix onto the modified rendering matrix, are quantized with comparatively high resolution and larger values of the linear combination parameter, which describe a smaller contribution of the user-specified rendering matrix onto the modified rendering matrix are quantized with comparatively lower resolution. It has been found that in many cases only extreme settings of the rendering matrix bring along significant audible distortions. Accordingly, it has been found that a fine adjustment of the linear combination parameter is more important in the region of a stronger contribution of the user-specified rendering matrix onto the target rendering matrix, in order to obtain a setting which allows for an optimal trade-off between a fulfillment of a user's rendering expectation and a minimization of audible distortions.

In an embodiment, the apparatus is configured to evaluate a bitstream element describing a distortion limitation mode. In this case, the distortion limiter is advantageously configured to selectively obtain the target rendering matrix such that the target rendering matrix is a downmix-similar target rendering matrix or such that the target rendering matrix is a best-effort target rendering matrix. It has been found that such a switchable concept provides for an efficient possibility to obtain a good trade-off between a fulfillment of a user's rendering expectations and a minimization of the audible distortions for a large number of different audio pieces. This concept also allows for a good control of an audio signal encoder over the actual rendering at the decoder side. Consequently, the requirements of a large variety of different audio services can be fulfilled.

Another embodiment according to the invention creates an apparatus for providing a bitstream representing a multi-channel audio signal.

The apparatus comprises a downmixer configured to provide a downmix signal on the basis of a plurality of audio object signals. The apparatus also comprises a side information provider configured to provide an object-related parametric side information, describing characteristics of the audio object signals and downmix parameters, and a linear combination parameter describing contributions of a user-specified rendering matrix and of a target rendering matrix to a modified rendering matrix. The apparatus for providing a bitstream also comprises a bitstream formatter configured to provide a bitstream comprising a representation of the downmix signal, the object-related parametric side information and the linear combination parameter.

This apparatus for providing a bitstream representing a multi-channel audio signal is well-suited for cooperation with the above-discussed apparatus for providing an upmix signal representation. The apparatus for providing a bitstream representing a multi-channel audio signal allows for providing the linear combination parameter in dependence on its knowledge of the audio object signals. Accordingly, the audio encoder (i.e., the apparatus for providing a bitstream representing a multi-channel audio signal) can have a strong impact on the rendering quality provided by an audio decoder (i.e., the above-discussed apparatus for providing an upmix signal representation) which evaluates the linear combination parameter. Thus, the apparatus for providing the bitstream representing a multi-channel audio signal has a very high level of control over the rendering result, which provides for an improved user satisfaction in the many different scenarios. Accordingly, it is indeed the audio encoder of a service provider which provides guidance, using the linear combination parameter, whether the user should be allowed or not to use extreme rendering settings at the risk of audible distortions. Thus, user disappointment, along with the corresponding negative economic consequences, can be avoided by using the above-described audio encoder.

Another embodiment according to the invention creates a method for providing an upmix signal representation on the basis of a downmix signal representation and an object-related parameter information, which are included in a bitstream representation of the audio content, in dependence on a user-specified rendering matrix. This method is based on the same key idea as the above-described apparatus.

Another method according to the invention creates a method for providing a bitstream representing a multi-channel audio signal. Said method is based on the same finding as the above-described apparatus.

Another embodiment according to the invention creates a computer program for performing the above methods.

Another embodiment according to the invention creates a bitstream representing a multi-channel audio signal. The bitstream comprises a representation of a downmix signal combining audio signals of a plurality of audio objects in an object-related parametric side information describing characteristics of the audio objects. The bitstream also comprises a linear combination parameter describing contributions of a user-specified rendering matrix and of a target rendering matrix to a modified rendering matrix. Said bitstream allows for some degree of control over the decoder-sided rendering parameters from the side of the audio signal encoder.

BRIEF DESCRIPTION OF THE DRAWINGS

Embodiments according to the present invention will subsequently be described taking reference to the enclosed figures, in which:

FIG. 3*b* shows a detailed syntax representation of an SAOC specific configuration information, according to an embodiment of the invention;

FIG. 3*c* shows a detailed syntax representation of an SAOC frame information, according to an embodiment of the invention;

FIG. 3*d* shows a schematic representation of an encoding of a distortion control mode in a bitstream element "bsDcuMode" which can be used in a SAOC bitstream;

FIG. 3*e* shows a table representation of an association between a bitstream index idx and a value of a linear combination parameter "DcuParam[idx]", which can be used for encoding a linear combination information in an SAOC bitstream;

FIG. 5*a* shows a syntax representation of an SAOC specific configuration information, according to an embodiment of the invention;

FIG. 5*b* shows a table representation of an association between a bitstream index idx and a linear combination parameter Param[idx] which can be used for encoding the linear combination parameter in an SAOC bitstream;

FIG. 6*a* shows a table describing listening test conditions;

FIG. 6*b* shows a table describing audio items of the listening tests;

FIG. 6*c* shows a table describing tested downmix/rendering conditions for a stereo-to-stereo SAOC decoding scenario;

DETAILED DESCRIPTION OF THE INVENTION

1. Apparatus for Providing an Upmix Signal Representation, According to FIG. 1*a*

Figure 1A:
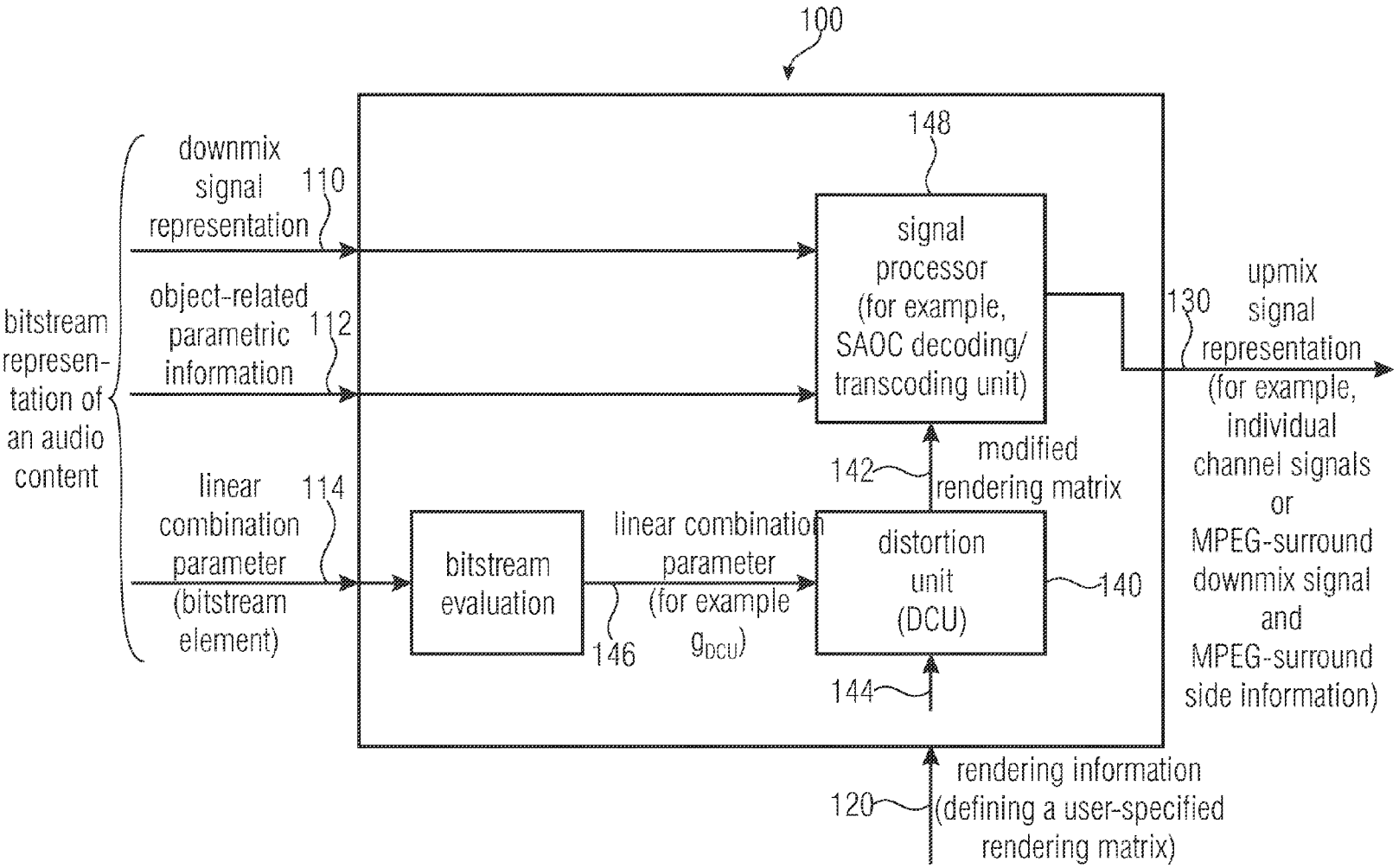
FIG. 1*a* shows a block schematic diagram of an apparatus for providing an upmix signal representation, according to an embodiment of the invention.

FIG. 1*a* shows a block schematic diagram of an apparatus for providing an upmix signal representation, according to an embodiment of the invention.

The apparatus 100 is configured to receive a downmix signal representation 110 and an object-related parametric information 112. The apparatus 100 is also configured to receive a linear combination parameter 114. The downmix signal representation 110, the object-related parametric information 112 and the linear combination parameter 114 are all included in a bitstream representation of an audio content. For example, the linear combination parameter 114 is described by a bitstream element within said bitstream representation. The apparatus 100 is also configured to receive a rendering information 120, which defines a user-specified rendering matrix.

The apparatus 100 is configured to provide an upmix signal representation 130, for example, individual channel signals or an MPEG surround downmix signal in combination with an MPEG surround side information.

The apparatus 100 comprises a distortion limiter 140 which is configured to obtain a modified rendering matrix 142 using a linear combination of a user-specified rendering matrix 144 (which is described, directly or indirectly, by the rendering information 120) and a target rendering matrix in dependence on a linear combination parameter 146, which may, for example, be designated with $g_{DCU}$.

The apparatus 100 may, for example, be configured to evaluate a bitstream element 114 representing the linear combination parameter 146 in order to obtain the linear combination parameter.

The apparatus 100 also comprises a signal processor 148 which is configured to obtain the upmix signal representation 130 on the basis of the downmix signal representation 110 and the object-related parametric information 112 using the modified rendering matrix 142.

Accordingly, the apparatus 100 is capable of providing the upmix signal representation with good rendering quality using, for example, an SAOC signal processor 148, or any other object-related signal processor 148. The modified rendering matrix 142 is adapted by the distortion limiter 140 such that a sufficiently good hearing impression with sufficiently small distortions is, in most or all cases, achieved. The modified rendering matrix typically lies "in-between" the user-specified (desired) rendering matrix and the target rendering matrix, wherein a degree of similarity of the modified rendering matrix to the user-specified rendering matrix and to the target rendering matrix is determined by the linear combination parameter, which consequently allows for an adjustment of an achievable rendering quality and/or of a maximum distortion level of the upmix signal representation 130.

The signal processor 148 may, for example, be an SAOC signal processor. Accordingly, the signal processor 148 may be configured to evaluate the object-related parametric information 112 to obtain parameters describing characteristics of the audio objects represented, in a downmixed form, by the downmix signal representation 110. In addition, the signal processor 148 may obtain (for example, receive) parameters describing the downmix procedure, which is used at the side of an audio encoder providing the bitstream representation of the audio content in order to derive the downmix signal representation 110 by combining the audio object signals of a plurality of audio objects. Thus, the signal processor 148 may, for example, evaluate an object-level difference information OLD describing a level difference between a plurality of audio objects for a given audio frame and one or more frequency bands, and an inter-object correlation information IOC describing a correlation between audio signals of a plurality of pairs of audio objects for a given audio frame and for one or more frequency bands. In addition, the signal processor 148 may also evaluate a downmix information DMG, DCLD describing a downmix, which is performed at the side of an audio encoder providing the bitstream representation of the audio content, for example, in the form of one or more downmix gain parameters DMG and one or more downmix channel level difference parameters DCLD.

In addition, the signal processor 148 receives the modified rendering matrix 142, which indicates which audio channels of the upmix signal representation 130 should comprise an audio content of the different audio objects. Accordingly, the signal processor 148 is configured to determine the contributions of the different audio objects to downmix signal representation 110 using its knowledge (obtained from the OLD information and the IOC information) of the audio objects as well as its knowledge of the downmix process (obtained from the DMG information and the DCLD information). Furthermore, the signal processor provides the upmix signal representation such that the modified rendering matrix 142 is considered.

Accordingly, the signal processor 148 fulfills the functionality of the SAOC decoder 820, wherein the downmix signal representation 110 takes the place of the one or more downmix signals 812, wherein the object-related parametric information 112 takes the place of the side information 814, and wherein the modified rendering matrix 142 takes the place of the user interaction/control information 822. The channel signals $\hat{y}_1$ to $\hat{y}_M$ take the role of the upmix signal representation 130. Accordingly, reference is made to the description of the SAOC decoder 820.

Similarly, the signal processor 148 may take the role of the decoder/mixer 920, wherein the downmix signal representation 110 takes the role of the one or more downmix signals, wherein the object-related parametric information 112 takes the role of the object metadata, wherein the modified rendering matrix 142 takes the role of the rendering information input to the mixer/renderer 926, and wherein the channel signal 928 takes the role of the upmix signal representation 130.

Alternatively, the signal processor 148 may perform the functionality of the integrated decoder and mixer 950, wherein the downmix signal representation 110 may take the role of the one or more downmix signals, wherein the object-related parametric information 112 may take the role of the object metadata, wherein the modified rendering matrix 142 may take the role of the rendering information input to the object decoder plus mixer/renderer 950, and wherein the channel signals 958 may take the role of the upmix signal representation 130.

Alternatively, the signal processor 148 may perform the functionality of the SAOC-to-MPEG surround transcoder 980, wherein the downmix signal representation 110 may take the role of the one or more downmix signals, wherein the object-related parametric information 112 may take the role of the object metadata, wherein the modified rendering matrix 142 may take the role of the rendering information, and wherein the one or more downmix signals 988 in combination with the MPEG surround bitstream 984 may take the role of the upmix signal representation 130.

Accordingly, for details regarding the functionality of the signal processor 148, reference is made to the description of the SAOC decoder 820, of the separate decoder and mixer 920, of the integrated decoder and mixer 950, and of the SAOC-to-MPEG surround transcoder 980. Reference is also made, for instance, to documents [3] and [4] with respect to the functionality of the signal processor 148, wherein the modified rendering matrix 142, rather than the user-specified rendering matrix 120, takes the role of the input rendering information in the embodiments according to the invention.

Further details regarding the functionality of the distortion limiter 140 will be described below.

2. Apparatus for Providing a Bitstream Representing a Multi-Channel Audio Signal, According to FIG. 1*b*

Figure 1B:
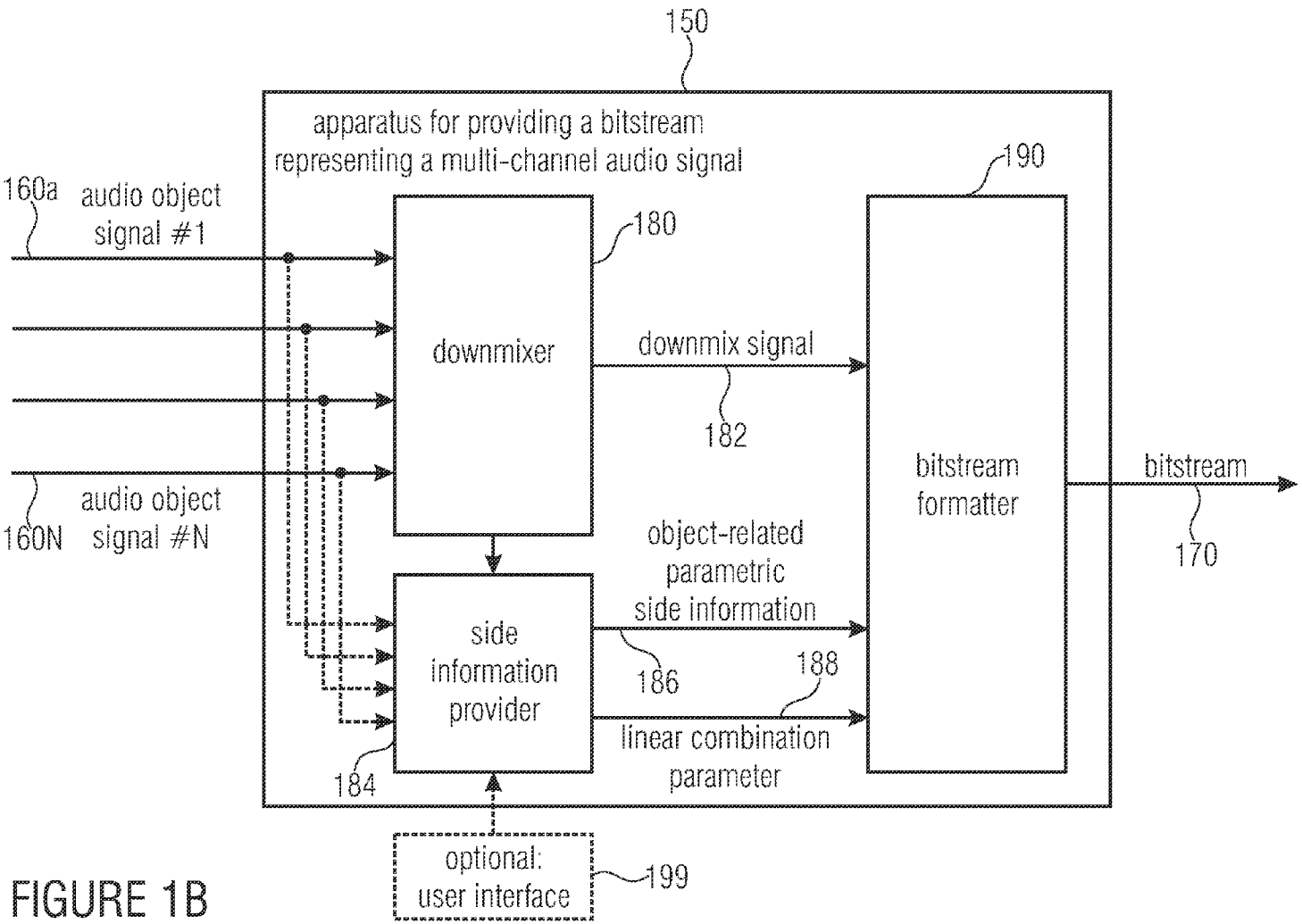
FIG. 1*b* shows a block schematic diagram of an apparatus for providing a bitstream representing a multi-channel audio signal, according to an embodiment of the invention.

FIG. 1*b* shows a block schematic diagram of an apparatus 150 for providing a bitstream representing a multi-channel audio signal.

The apparatus 150 is configured to receive a plurality of audio object signals 160*a* to 160N. The apparatus 150 is further configured to provide a bitstream 170 representing the multi-channel audio signal, which is described by the audio object signals 160*a* to 160N.

The apparatus 150 comprises a downmixer 180 which is configured to provide a downmix signal 182 on the basis of the plurality of audio object signals 160*a* to 160N. The apparatus 150 also comprises a side information provider 184 which is configured to provide an object-related parametric side information 186 describing characteristics of the audio object signals 160*a* to 160N and downmix parameters used by the downmixer 180. The side information provider 184 is also configured to provide a linear combination parameter 188 describing a desired contribution of a (desired) user-specified rendering matrix and of a target (low-distortion) rendering matrix to a modified rendering matrix.

The object-related parametric side information 186 may, for example, comprise an object-level-difference information (OLD) describing object-level-differences of the audio object signals 160*a* to 160N (e.g., in a band-wise manner). The object-related parametric side information may also comprise an inter-object-correlation information (IOC) describing correlations between the audio object signals 160*a* to 160N. In addition, the object-related parametric side information may describe the downmix gain (e.g., in an object-wise manner), wherein the downmix gain values are used by the downmixer 180 in order to obtain the downmix signal 182 combining the audio object signals 160*a* to 160N. The object-related parametric side information 186 may comprise a downmix-channel-level-difference information (DCLD), which describes the differences between the downmix levels for multiple channels of the downmix signal 182 (e.g., if the downmix signal 182 is a multi-channel signal).

The linear combination parameter 188 may for example be a numeric value between 0 and 1, describing to use only a user-specified downmix matrix (e.g., for a parameter value of 0), only a target rendering matrix (e.g., for a parameter value of 1) or any given combination of the user-specified rendering matrix and the target rendering matrix in-between these extremes (e.g., for parameter values between 0 and 1).

The apparatus 150 also comprises a bitstream formatter 190 which is configured to provide the bitstream 170 such that the bitstream comprises a representation of the downmix signal 182, the object-related parametric side information 186 and the linear combination parameter 188.

Figure 8:
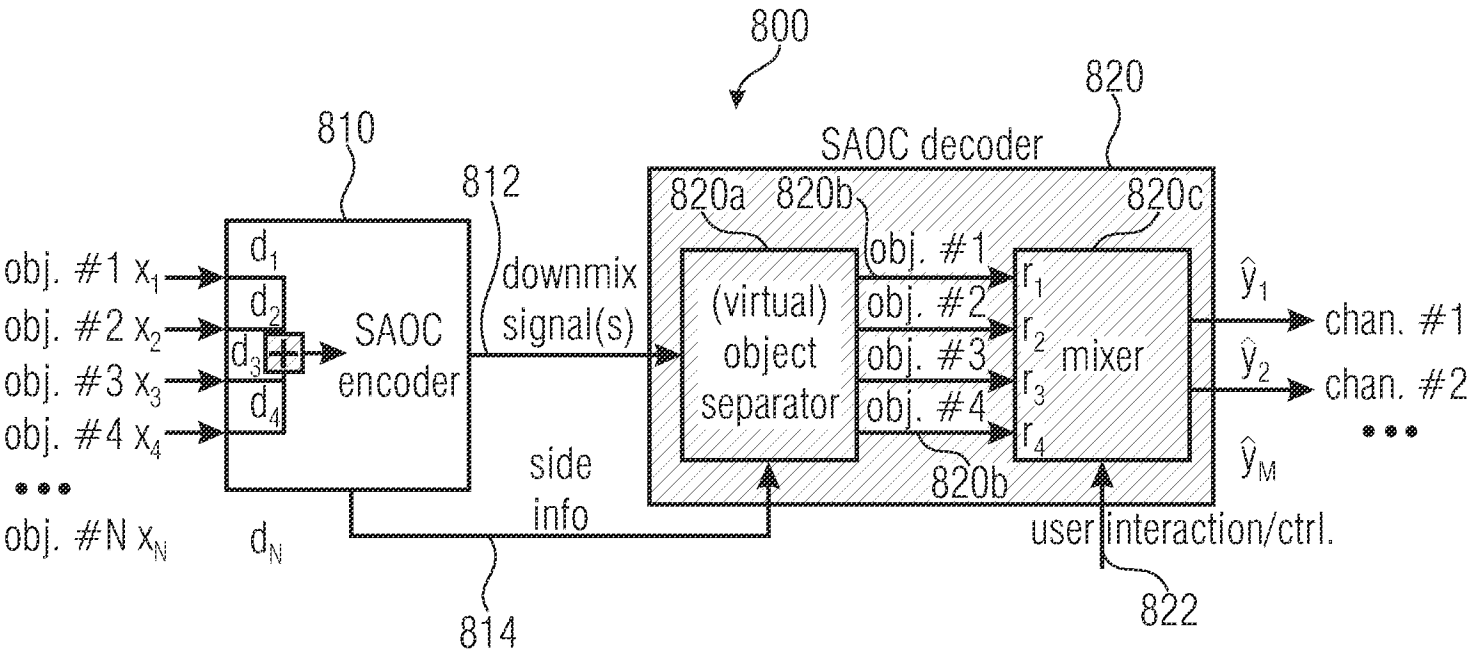
FIGURE 8 Prior Art
FIG. 8 shows a block schematic diagram of a reference MPEG SAOC system.
Figure 9A:
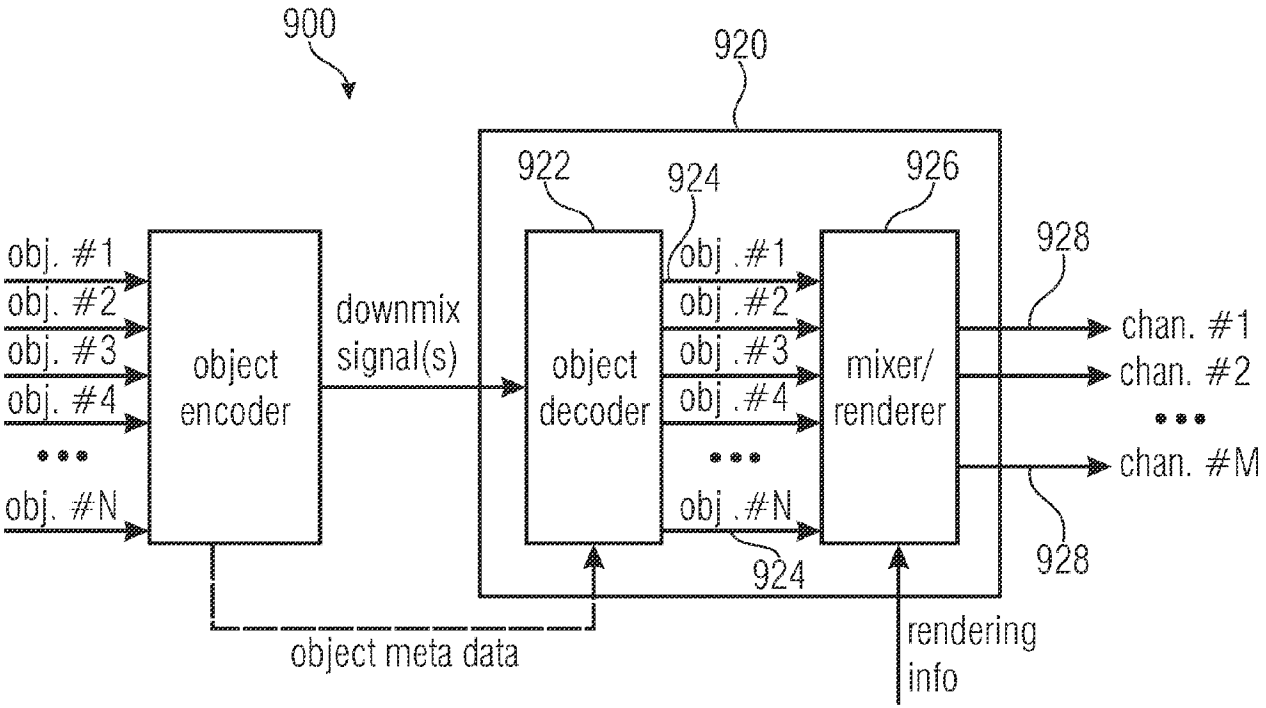
FIGURE 9A Prior Art
FIG. 9*a* shows a block schematic diagram of a reference SAOC system using a separate decoder and mixer.
Figure 9B:
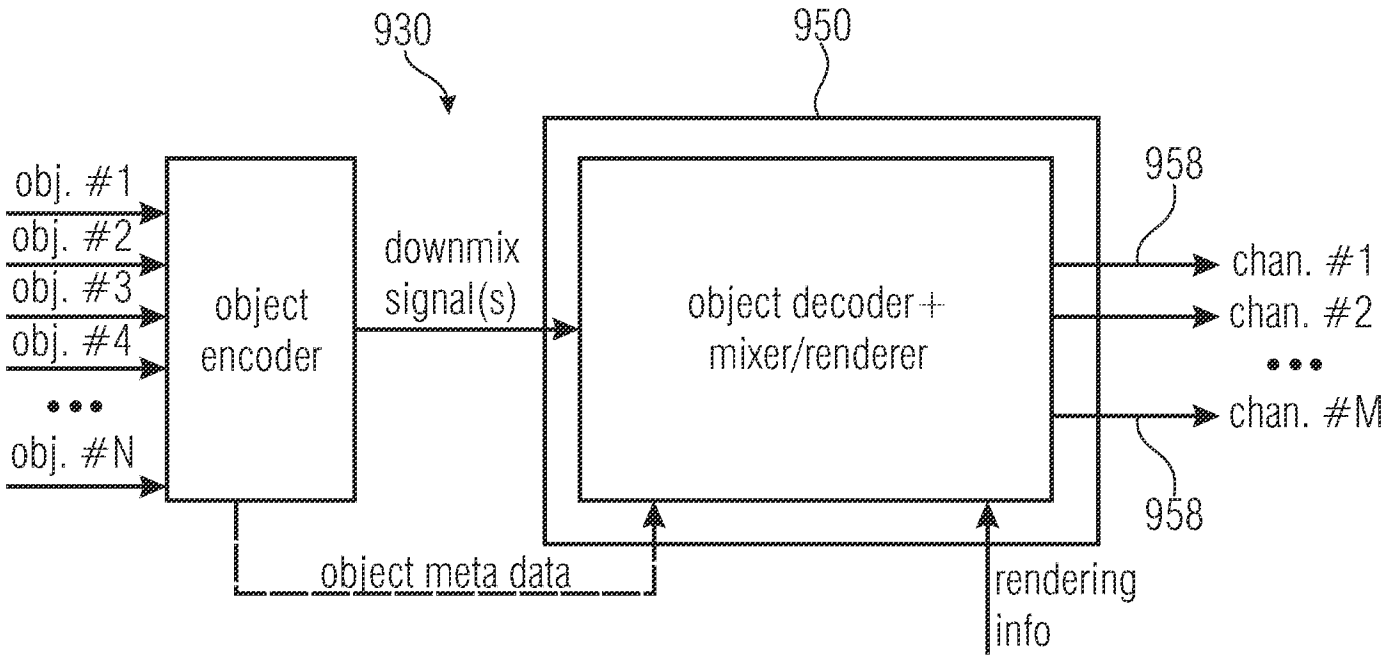
FIG 9B Prior Art
FIG. 9*b* shows a block schematic diagram of a reference SAOC system using an integrated decoder and mixer.
Figure 9C:
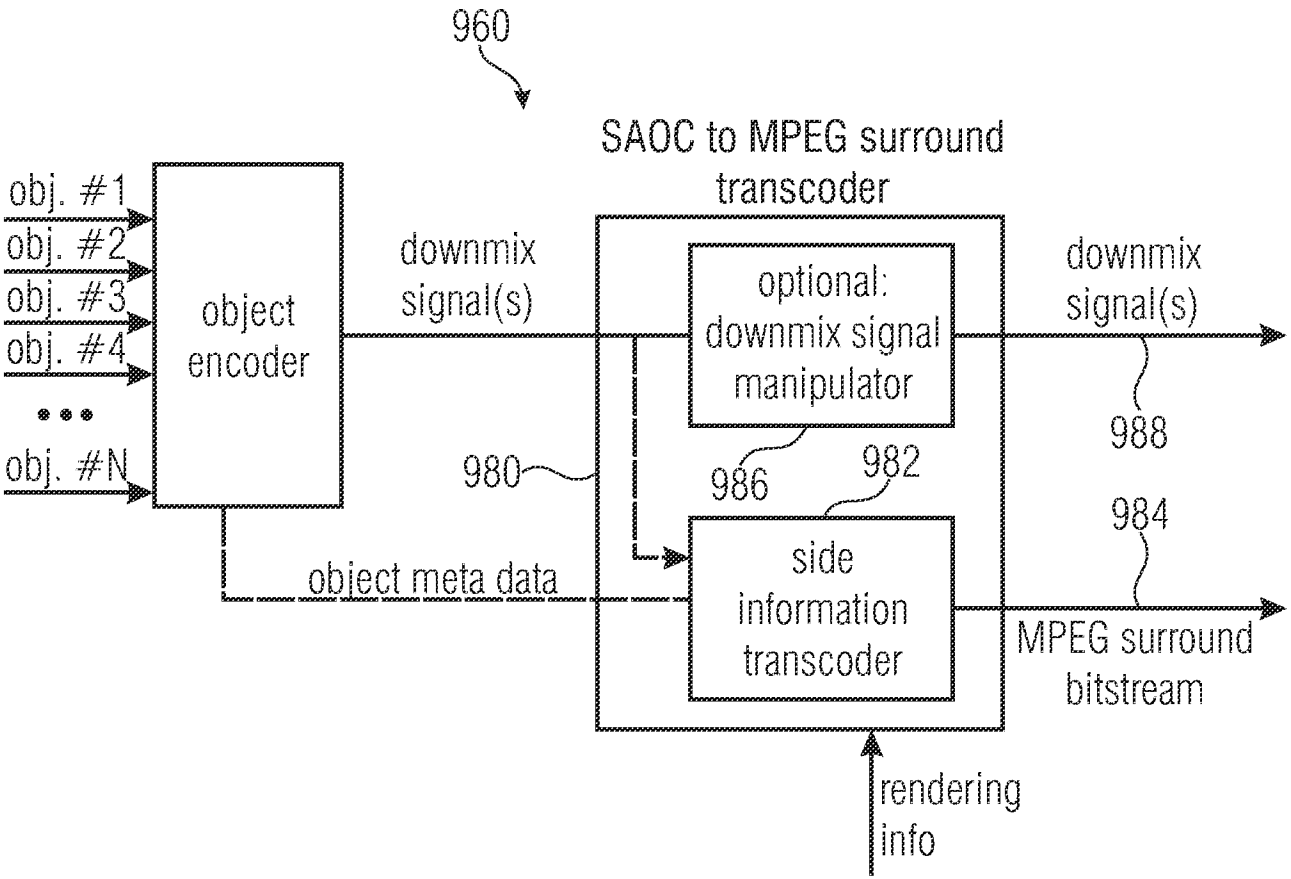
FIGURE 9C Prior Art
FIG. 9*c* shows a block schematic diagram of a reference SAOC system using an SAOC-to-MPEG transcoder.

Accordingly, the apparatus 150 performs the functionality of the SAOC encoder 810 according to FIG. 8 or of the object encoder according to FIGS. 9*a*-9*c*. The audio object signals 160*a* to 160N are equivalent to the object signals $x_1$ to $x_N$ received, for example, by the SAOC encoder 810. The downmix signal 182 may, for example, be equivalent to one or more downmix signals 812. The object-related parametric side information 186 may, for example, be equivalent to the side information 814 or to the object metadata. However, in addition to a said 1-channel downmix signal or a multi-channel downmix signal 182 and said object-related parametric side information 186, the bitstream 170 may also encode the linear combination parameter 188.

Accordingly, the apparatus 150, which can be considered as an audio encoder, has an impact on a decoder-sided handling of the distortion control scheme, which is performed by the distortion limiter 140, by appropriately setting the linear combination parameter 188, such that the apparatus 150 expects a sufficient rendering quality provided by an audio decoder (e.g. an apparatus 100) receiving the bitstream 170.

For example, the side information provider 184 may set the linear combination parameter in dependence on a quality requirement information, which is received from an optional user interface 199 of the apparatus 150. Alternatively, or in addition, the side information provider 184 may also take into consideration characteristics of the audio object signals 160*a* to 160N, and of the downmixing parameters of the downmixer 180. For example, the apparatus 150 may estimate a degree of distortion, which is obtained at an audio decoder under the assumption of one or more worst case user-specified rendering matrices, and may adjust the linear combination parameter 188 such that a rendering quality, which is expected to be obtained by the audio signal decoder under the consideration of this linear combination parameter, is still considered as being sufficient by the side information provider 184. For example, the apparatus 150 may set the linear combination parameter 188 to a value allowing for a strong user impact (influence of the user-specified rendering matrix) onto the modified rendering matrix, if the side information provider 184 finds that an audio quality of an upmix signal representation would not be degraded severely even in the presence of extreme user-specified rendering settings. This may, for example, be the case if the audio object signals 160*a* to 160N are sufficiently similar. In contrast, the side information provider 184 may set the linear combination parameter 188 to a value allowing for a comparatively small impact of the user (or of the user-specified rendering matrix), if the side information provider 184 finds that extreme rendering settings could lead to strong audible distortions. This may, for example, be the case if the audio object signals 160*a* to 160N are significantly different, such that a clear separation of audio objects at the side of the audio decoder is difficult (or connected with audible distortions).

It should be noted here that the apparatus 150 may use knowledge for the setting of the linear combination parameter 188 which is only available at the side to the apparatus 150, but not at the side of an audio decoder (e.g., the apparatus 100), such as, for example, a desired rendering quality information input to the apparatus 150 via a user interface or detailed knowledge about the separate audio objects represented by the audio object signals 160*a* and 160N.

Accordingly, the side information provider 184 can provide the linear combination parameter 188 in a very meaningful manner.

3. SAOC System with Distortion Control Unit (DCU), According to FIG. 2

3.1 SAOC Decoder Structure

In the following, a processing performed by a distortion control unit (DCU processing) will be described taking reference to FIG. 2, which shows a block schematic diagram of a SAOC system 200. Specifically, FIG. 2 illustrates the distortion control unit DCU within the overall SAOC system.

Figure 2:
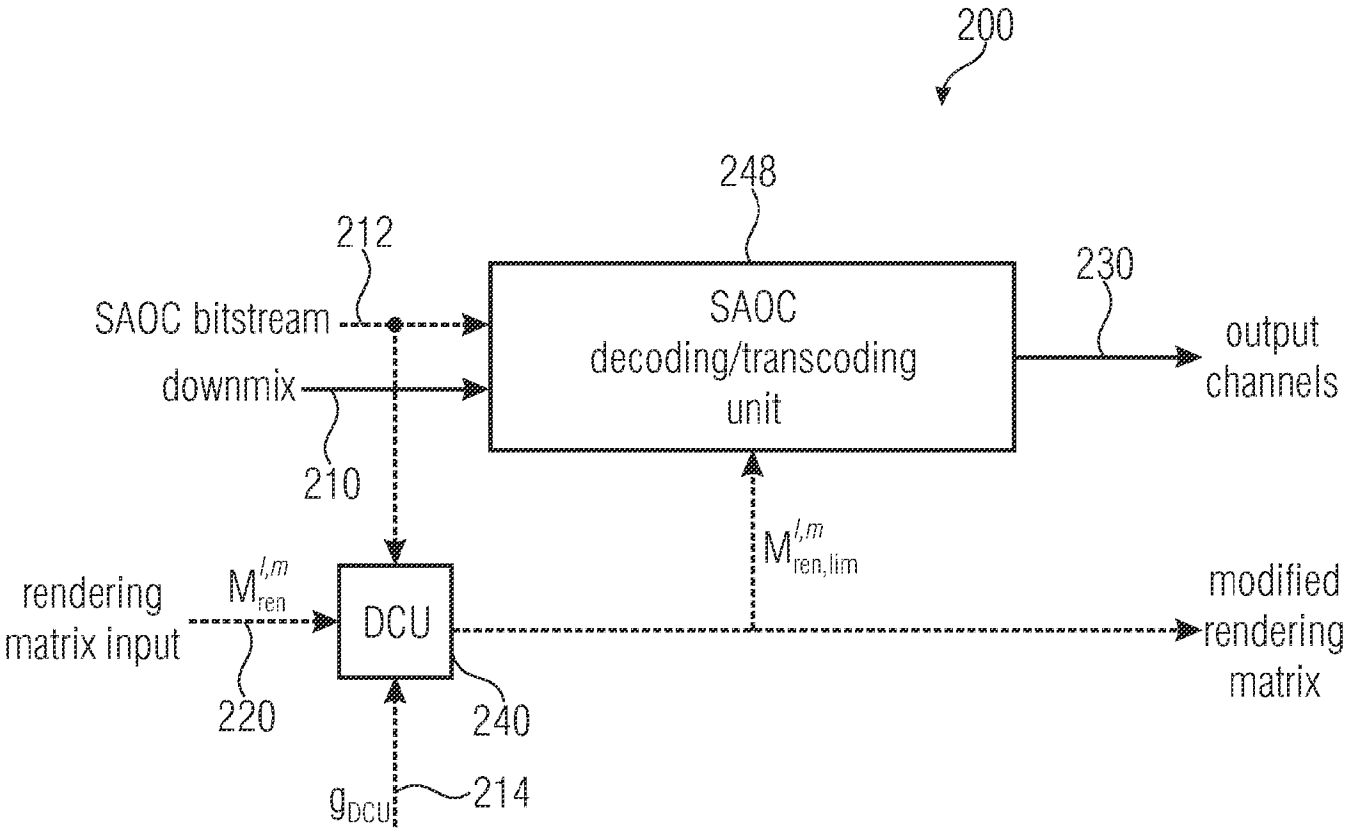
FIG. 2 shows a block schematic diagram of an apparatus for providing an upmix signal representation, according to another embodiment of the invention.

Taking reference to FIG. 2, the SAOC decoder 200 is configured to receive a downmix signal representation 210 representing, for example, a 1-channel downmix signal or a 2-channel downmix signal, or even a downmix signal having more than two channels. The SAOC decoder 200 is configured to receive an SAOC bitstream 212, which comprises an object-related parametric side information, such as, for instance, an object level difference information OLD, an inter-object correlation information IOC, a downmix gain information DMG, and, optionally, a downmix channel level difference information DCLD. The SAOC decoder 200 is also configured to obtain a linear combination parameter 214, which is also designated with $g_{DCU}$.

Typically, the downmix signal representation 210, the SAOC bitstream 212 and the linear combination parameter 214 are included in a bitstream representation of an audio content.

The SAOC decoder 200 is also configured to receive, for example, from a user interface, a rendering matrix input 220. For example, the SAOC decoder 200 may receive a rendering matrix input 220 in the form of a matrix $M_{ren}$, which defines the (user-specified, desired) contribution of a plurality of $N_{obj}$ audio objects to 1, 2, or even more output audio signal channels (of the upmix representation). The rendering matrix $M_{ren}$ may, for example, be input from a user interface, wherein the user interface may translate a different user-specified form of representation of a desired rendering setup into parameters of the rendering matrix $M_{ren}$. For example, the user-interface may translate an input in the form of level slider values and an audio object position information into a user-specified rendering matrix $M_{ren}$ using some mapping. It should be noted here that throughout the present description, the indices $^{l}$ defining a parameter time slot and $^{m}$ defining a processing band are sometimes omitted for the sake of clarity. Nevertheless, it should be kept in mind that the processing may be performed individually for a plurality of subsequent parameter time slots having indices l and for a plurality of frequency bands having frequency band indices m.

The SAOC decoder 200 also comprises a distortion control unit DCU 240 which is configured to receive the user-specified rendering matrix $M_{ren}$, at least a part of the SAOC bitstream information 212 (as will be described in detail below) and the linear combination parameter 214. The distortion control unit 240 provides the modified rendering matrix $M_{ren,lim}$.

The audio decoder 200 also comprises an SAOC decoding/transcoding unit 248, which may be considered as a signal processor, and which receives the downmix signal representation 210, the SAOC bitstream 212 and the modified rendering matrix $M_{ren,lim}$. The SAOC decoding/transcoding unit 248 provides a representation 230 of one or more output channels, which may be considered as an upmix signal representation. The representation 230 of the one or more output channels may, for example, take the form of a frequency domain representation of individual audio signal channels, of a time domain representation of individual audio channels or of a parametric multi-channel representation. For example, the upmix signal representation 230 make take the form of an MPEG surround representation comprising an MPEG surround downmix signal and an MPEG surround side information.

It should be noted that the SAOC decoding/transcoding unit 248 may comprise the same functionality as a signal processor 148, and may be equivalent to the SAOC decoder 820, to the separate coder and mixer 920, to the integrated decoder and mixer 950 and to the SAOC-to-MPEG surround transcoder 980.

3.2 Introduction into the Operation of the SAOC Decoder

In the following, a brief introduction into the operation of the SAOC decoder 200 will be given.

Within the overall SAOC system, the distortion control unit (DCU) is incorporated into the SAOC decoder/transcoder processing chain between the rendering interface (e.g., a user interface at which the user-specified rendering matrix, or an information from which the user-specified rendering matrix can be derived, is input) and the actual SAOC decoding/transcoding unit.

The distortion control unit 240 provides a modified rendering matrix $M_{ren,lim}$ using the information from the rendering interface (e.g. the user-specified rendering matrix input, directly or indirectly, via the rendering interface or user interface) and SAOC data (e.g., data from the SAOC bitstream 212). For more details, reference is made to FIG. 2. The modified rendering matrix $M_{ren,lim}$ can be accessed by the application (e.g., the SAOC decoding/transcoding unit 248), reflecting the actually effective rendering settings.

Based on the user-specified rendering scenario represented by the (user-specified) rendering matrix $M_{ren}^{l,m}$ with elements $m_{i,j}^{l,m}$, the DCU prevents extreme rendering settings by producing a modified matrix $M_{ren,lim}^{l,m}$ comprising limited rendering coefficients, which shall be used by the SAOC rendering engine. For all operational modes of SAOC, the final (DCU processed) rendering coefficients shall be calculated according to:

$$M_{ren,lim}^{l,m}=(1-g_{DCU})M_{ren}^{l,m}+g_{DCU}M_{ren,tar}^{l,m}.$$

The parameter $g_{DCU}\in[0,1]$ which is also designated as a linear combination parameter, is used to define the degree of transition from the user specified rendering matrix $M_{ren}^{l,m}$ towards the distortion-free target matrix $M_{ren,tar}^{l,m}$.

The parameter $g_{DCU}$ is derived from the bitstream element "bsDcuParam" according to:

$$g_{DCU}=\text{DcuParam[bsDcuParam]}.$$

Accordingly, a linear combination between the user-specified rendering matrix $M_{ren}$ and the distortion-free target rendering matrix $M_{ren,tar}$ is formed in dependence on the linear combination parameter $g_{DCU}$. The linear combination parameter $g_{DCU}$ is derived from a bitstream element, such that there is no difficult computation of said linear combination parameter $g_{DCU}$ needed (at least at the decoder side). Also, deriving the linear combination parameter $g_{DCU}$ from the bitstream, including the downmix signal representation 210, the SAOC bitstream 212 and the bitstream element representing the linear combination parameter, gives an audio signal encoder a chance to partially control the distortion control mechanism, which is performed at the side of the SAOC decoder.

There are two possible versions of the distortion-free target matrix $M_{ren,tar}^{l,m}$, suited for different applications. It is controlled by the bitstream element "bsDcuMode":

("bsDcuMode"=0): The "downmix-similar" rendering, where $M_{ren,tar}^{l,m}$ corresponds to the energy normalized downmix matrix.

("bsDcuMode"=1): The "best effort" rendering, where $M_{ren,tar}^{l,m}$ is defined as a function of both downmix and user-specified rendering matrix.

To summarize, there are two distortion control modes called "downmix-similar" rendering and "best effort" rendering, which can be selected in accordance with the bitstream elements "bsDcuMode". These two modes differ in the way their target rendering matrix is computed. In the following, details regarding the computation of the target rendering matrix for the two modes "downmix-similar" rendering and "best effort" rendering will be described in detail.

3.3 "Downmix-Similar" Rendering 3.3.1 Introduction

The "downmix-similar" rendering method can typically be used in cases where the downmix is an important reference of artistic high quality. The "downmix-similar" rendering matrix $M_{ren,DS}^{l}$ is computed as $$M_{ren,DS}^{l}=M_{ren,tar}^{l}=\sqrt{N_{DS}^{l}}D_{DS}^{l},$$

where $N_{DS}^{l}$ represents an energy normalization scalar (for each parameter slot l) and $D_{DS}^{l}$ is the downmix matrix $D^{l}$ extended by rows of zero elements such that number and order of the rows of $D_{DS}^{l}$ correspond to the constellation of $M_{ren}^{l,m}$.

For example, in the SAOC stereo to multichannel transcoding mode $N_{MPS}=6$. Accordingly $D_{DS}^{l}$ is of size $N_{MPS}\times N$ (where N depicts the number of input audio objects) and its rows representing the front left and right output channels equal $D^{l}$ (or corresponding rows of $D^{l}$).

To facilitate the understanding of the above, the following definitions of the rendering matrix and of the downmix matrix should be considered.

The (modified) rendering matrix $M_{ren,lim}$ applied to the input audio objects S determines the target rendered output as $Y=M_{ren,lim}S$. The (modified) rendering matrix $M_{ren,lim}$ with elements $m_{i,j}$ maps all input objects i (i.e., input objects having object index i) to the desired output channels j (i.e., output channels having channel index j). The (modified) rendering matrix $M_{ren,lim}$ is given by $$M_{ren,lim}=\begin{pmatrix} m_{0,Lf} & \dots & m_{N-1,Lf} \\ m_{0,Rf} & \dots & m_{N-1,Rf} \\ m_{0,C} & \dots & m_{N-1,C} \\ m_{0,Lfe} & \dots & m_{N-1,Lfe} \\ m_{0,Ls} & \dots & m_{N-1,Ls} \\ m_{0,Rs} & \dots & m_{N-1,Rs} \end{pmatrix},$$

for 5.1 output configuration, $$M_{ren,lim}=\begin{pmatrix} m_{0,L} & \dots & m_{N-1,L} \\ m_{0,R} & \dots & m_{N-1,R} \end{pmatrix},$$

for stereo output configuration, $M_{ren,lim}=(m_{0,C} \dots m_{N-1,C})$, for mono output configuration.

The same dimensions typically also apply to the user-specified rendering matrix $M_{ren}$ and the target rendering matrix $M_{ren,tar}$.

The downmix matrix D applied to the input audio objects S (in an audio decoder) determines the downmix signal as X=DS.

For the stereo downmix case, the downmix matrix D of size 2×N (also designated with $D^l$, to show a possible time dependency) with elements $d_{i,j}$ (i=0,1; j=0, . . . , N−1) is obtained (in an audio decoder) from the DMG and DCLD parameters as $$d_{0,j}=10^{0.05DMG_j}\sqrt{\frac{10^{0.1DCLD_j}}{1+10^{0.1DCLD_j}}},$$

$$d_{1,j}=10^{0.05DMG_j}\sqrt{\frac{1}{1+10^{0.1DCLD_j}}}.$$

For the mono downmix case the downmix matrix D of size 1×N with elements $d_{i,j}$ (i=0; j=0, . . . , N−1) is obtained (in an audio decoder) from the DMG parameters as $$d_{0,j}=10^{0.05\,DMG_j}.$$

The downmix parameters DMG and DCLD are obtained from the SAOC bitstream 212.

3.3.2 Computation of the Energy Normalization Scalar for all Decoding/Transcoding SAOC Modes For all decoding/transcoding SAOC modes the energy normalization scalar $N_{DS}^{l}$ is computed using the following equation:

$$N_{DS}^{l}=\frac{\mathrm{trace}(M_{ren}^{l,m}(M_{ren}^{l,m})^*)+\varepsilon}{\mathrm{trace}(D^l(D^l)^*)+\varepsilon}.$$

3.4 "Best-Effort" Rendering 3.4.1 Introduction

The "best effort" rendering method can typically be used in cases where the target rendering is an important reference.

The "best effort" rendering matrix describes a target rendering matrix, which depends on the downmix and rendering information. The energy normalization is represented by a matrix $N_{BE}^{l,m}$ of size $N_{MPS}$×M, hence it provides individual values for each output channel. This requests different calculations of $N_{BE}^{l,m}$ for the different SAOC operation modes, which are outlined in the following. The "best effort" rendering matrix is computed as $M_{ren,BE}^{l}=M_{ren,tar}^{l}=\sqrt{N_{BE}^{l}}D^l$, for the following SAOC modes "x-1-1/2/5/b", "x-2-1/b", $M_{ren,BE}^{l}=M_{ren,tar}^{l}=N_{BE}^{l}D^l$, for the following SAOC modes "x-2-2/5".

Here $D^l$ is the downmix matrix and $N_{BE}^{l,m}$ represents the energy normalization matrix.

The square root operator in the above equation designates an element-wise square root formation.

In the following, the computation of the value $N_{BE}^{l}$, which may be an energy normalization scalar in the case of an SAOC mono-to-mono decoding mode, and which may be an energy normalization matrix in the case of other decoding modes or transcoding modes, will be discussed in detail.

3.4.2 SAOC Mono-to-Mono ("x-1-1") Decoding Mode

For the "x-1-1" SAOC mode in which a mono downmix signal is decoded to obtain a mono output signal (as an upmix signal representation), the energy normalization scalar $N_{BE}^{l,m}$ is computed using the following equation $$N_{BE}^{l,m}=\frac{\sum_{j=0}^{N-1}(m_{j,0}^{l,m})^2+\varepsilon}{\sum_{j=0}^{N-1}(d_j^l)^2+\varepsilon}.$$

3.4.3 SAOC Mono-to-Stereo ("x-1-2") Decoding Mode

For the "x-1-2" SAOC mode, in which a mono downmix signal is decoded to obtain a stereo (2-channel) output (as an upmix signal representation), the energy normalization matrix $N_{BE}^{l,m}$ of size 2×1 is computed using the following equation $$N_{BE}^{l,m}=\begin{pmatrix} \frac{\sum_{j=0}^{N-1}(m_{j,0}^{l,m})^2+\varepsilon}{\sum_{j=0}^{N-1}(d_j^l)^2+\varepsilon}, & \frac{\sum_{j=0}^{N-1}(m_{j,1}^{l,m})^2+\varepsilon}{\sum_{j=0}^{N-1}(d_j^l)^2+\varepsilon} \end{pmatrix}^T.$$

3.4.4 SAOC Mono-to-Binaural ("x-1-b") Decoding Mode

For the "x-1-b" SAOC mode, in which a mono downmix signal is decoded to obtain a binaural rendered output signal (as an upmix signal representation), the energy normalization matrix $N_{BE}^{l,m}$ of size 2×1 is computed using the following equation $$N_{BE}^{l,m}=\begin{pmatrix} \frac{\sum_{j=0}^{N-1}a_{j,1}^{l,m}(a_{j,1}^{l,m})^*+\varepsilon}{\sum_{j=0}^{N-1}(d_j^l)^2+\varepsilon}, & \frac{\sum_{j=0}^{N-1}a_{j,2}^{l,m}(a_{j,2}^{l,m})^*+\varepsilon}{\sum_{j=0}^{N-1}(d_j^l)^2+\varepsilon} \end{pmatrix}^T.$$

The elements $a_{x,y}^{l,m}$ comprise (or are taken from) the target binaural rendering matrix $A^{l,m}$.

3.4.5 SAOC Stereo-to-Mono ("x-2-1") Decoding Mode

For the "x-2-1" SAOC mode, in which a two-channel (stereo) downmix signal is decoded to obtain a one-channel (mono) output signal (as an upmix signal representation), the energy normalization matrix $N_{BE}^{l,m}$ of size 1×2 is computed using the following equation $$N_{BE}^{l,m}=M_{ren}^{l,m}(D^l)^*J^l,$$

where $M_{ren}^{l,m}$ is mono rendering matrix of size 1×N.

3.4.6 SAOC Stereo-to-Stereo ("x-2-2") Decoding Mode

For the "x-2-2" SAOC mode, in which a stereo downmix signal is decoded to obtain a stereo output signal (as an upmix signal representation), the energy normalization matrix $N_{BE}^{l,m}$ of size 2×2 is computed using the following equation $$N_{BE}^{l,m}=M_{ren}^{l,m}(D^l)^*J^l,$$

where $M_{ren}^{l,m}$ is stereo rendering matrix of size 2×N.

3.4.7 SAOC Stereo-to-Binaural ("x-2-b") Decoding Mode

For the "x-2-b" SAOC mode, in which a stereo downmix signal is decoded to obtain a binaural-rendered output signal (as an upmix signal representation), the energy normalization matrix $N_{BE}^{l,m}$ of size 2×2 is computed using the following equation $$N_{BE}^{l,m}=A^{l,m}(D^l)^*J^l,$$

where $A^{l,m}$ is a binaural rendering matrix of size 2×N.

3.4.8 SAOC Mono-to-Multichannel ("x-1-5") Transcoding Mode

For the "x-1-5" SAOC mode, in which a mono downmix signal is transcoded to obtain a 5-channel or 6-channel output signal (as an upmix signal representation), the energy normalization matrix $N_{BE}^{l,m}$ of size $N_{MPS}$×1 is computed using the following equation $$N_{BE}^{l,m}=\left(\frac{\sum_{j=0}^{N-1}(m_{j,0}^{l,m})^2+\varepsilon}{\sum_{j=0}^{N-1}(d_j^l)^2+\varepsilon},\ldots,\frac{\sum_{j=0}^{N-1}(m_{j,N_{MPS}-1}^{l,m})^2+\varepsilon}{\sum_{j=0}^{N-1}(d_j^l)^2+\varepsilon}\right)^T.$$

3.4.9 SAOC Stereo-to-Multichannel ("x-2-5") Transcoding Mode

For the "x-2-5" SAOC mode, in which a stereo downmix signal is transcoded to obtain a 5-channel or 6-channel output signal (as an upmix signal representation), the energy normalization matrix $N_{BE}^{l,m}$ of size $N_{MPS}$×2 is computed using the following equation $$N_{BE}^{l,m}=M_{ren}^{l,m}(D^l)^*J^l,$$

3.4.10 Computation of $J^l$

To avoid numerical problems when calculating the term $J^l=(D^l(D^l)^*)^{-1}$ in 3.4.5, 3.4.6, 3.4.7, and 3.4.9, $J^l$ is modified in some embodiments. First the eigenvalues $\lambda_{1,2}$ of $J^l$ are calculated, solving $\det(J-\lambda_{1,2}I)=0$.

Eigenvalues are sorted in descending ($\lambda_1 \geq \lambda_2$) order and the eigenvector corresponding to the larger eigenvalue is calculated according to the equation above. It is assured to lie in the positive x-plane (first element has to be positive). The second eigenvector is obtained from the first by −90 degrees rotation:

$$J=(v_1 v_2)\begin{pmatrix}\lambda_1 & 0\\ 0 & \lambda_2\end{pmatrix}(v_1 v_2)^*.$$

3.4.11 Distortion Control Unit (DCU) Application for Enhanced Audio Objects (EAO)

In the following, some optional extensions regarding the application of the distortion control unit will be described, which may be implemented in some embodiments according to the invention.

For SAOC decoders that decode residual coding data and thus support the handling of EAOs, it can be meaningful to provide a second parameterization of the DCU which allows taking advantage of the enhanced audio quality provided by the use of EAOs. This is achieved by decoding and using a second alternate set of DCU parameters (i.e. bsDcuMode2 and bsDcuParam2) which is additionally transmitted as part of the data structures containing residual data (i.e. SAOCExtensionConfigData( ) and SAOCExtensionFrameData( )). An application can make use of this second parameter set if it decodes residual coding data and operates in strict EAO mode which is defined by the condition that only EAOs can be modified arbitrarily while all non-EAOs only undergo a single common modification. Specifically, this strict EAO mode requests fulfillment of two following conditions:

The downmix matrix and rendering matrix have the same dimensions (implying that the number of rendering channels is equal to the number of downmix channels).

The application only employs rendering coefficients for each of the regular objects (i.e. non-EAOs) that are related to their corresponding downmix coefficients by a single common scaling factor.

4. Bitstream According to FIG. 3*a*

In the following, a bitstream representing a multi-channel audio signal will be described taking reference to FIG. 3*a* which shows a graphical representation of such a bitstream 300.

The bitstream 300 comprises a downmix signal representation 302, which is a representation (e.g., an encoded representation) of a downmix signal combining audio signals of a plurality of audio objects. The bitstream 300 also comprises an object-related parametric side information 304 describing characteristics of the audio object and, typically, also characteristics of a downmix performed in an audio encoder. The object-related parametric information 304 advantageously comprises an object level difference information OLD, an inter-object correlation information IOC, a downmix gain information DMG and a downmix channel level different information DCLD. The bitstream 300 also comprises a linear combination parameter 306 describing desired contributions of a user-specified rendering matrix and of a target rendering matrix to a modified rendering matrix (to be applied by an audio signal decoder).

Further optional details regarding this bitstream 300, which may be provided by the apparatus 150 as the bitstream 170, and which may be input into the apparatus 100 to obtain the downmix signal representation 110, the object-related parametric information 112 and the linear combination parameter 140, or into the apparatus 200 to obtain the downmix information 210, the SAOC bitstream information 212 and the linear combination parameter 214, will be described in the following taking reference to FIGS. 3*b* and 3*c*.

5. Bitstream Syntax Details 5.1. SAOC Specific Configuration Syntax

FIG. 3*b* shows a detailed syntax representation of an SAOC specific configuration information.

Figure 3A:
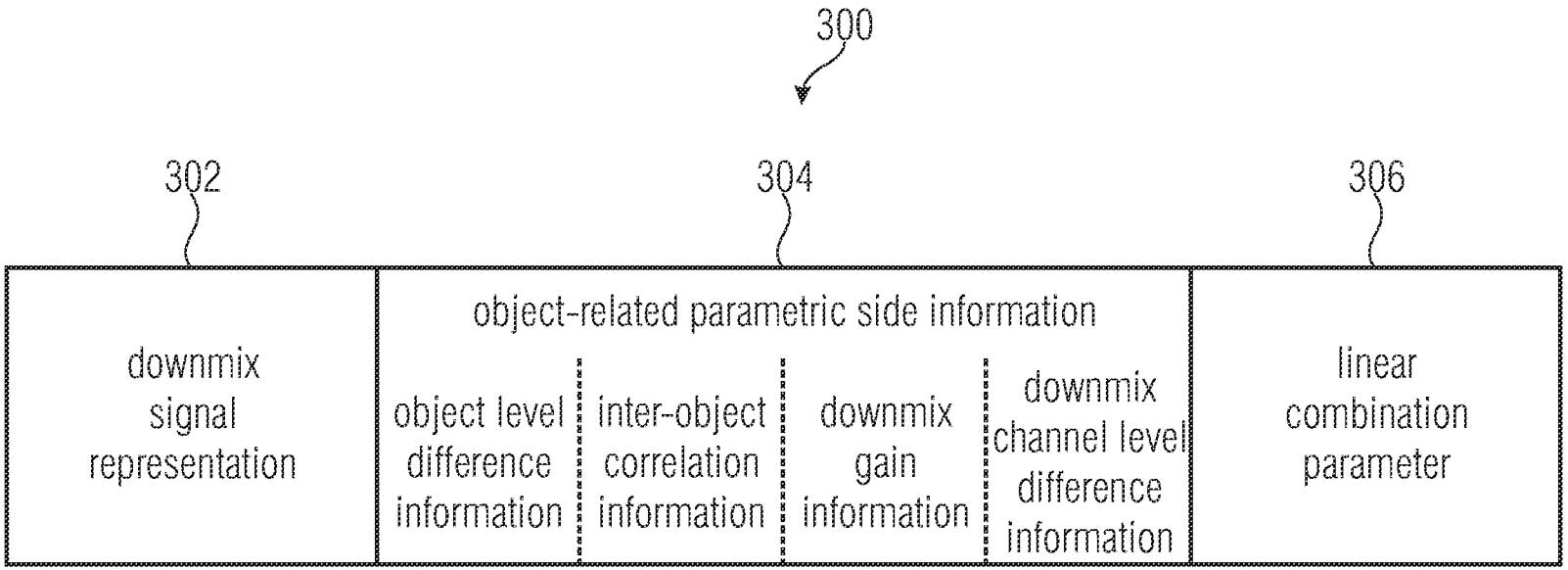
FIG. 3*a* shows a schematic representation of a bitstream representing a multi-channel audio signal, according to an embodiment of the invention.

The SAOC specific configuration 310 according to FIG. 3*b* may, for example, be part of a header of the bitstream 300 according to FIG. 3*a*.

The SAOC specific configuration may, for example, comprise a sampling frequency configuration describing a sampling frequency to be applied by an SAOC decoder. The SAOC specific configuration also comprises a low-delay-mode configuration describing whether a low-delay mode or a high-delay mode of the signal processor 148 or of the SAOC decoding/transcoding unit 248 should be used. The SAOC specific configuration also comprises a frequency resolution configuration describing a frequency resolution to be used by the signal processor 148 or by the SAOC decoding/transcoding unit 248. In addition, the SAOC specific configuration may comprise a frame length configuration describing a length of audio frames to be used by the signal processor 148, or by the SAOC decoding/transcoding unit 248. Moreover, the SAOC specific configuration typically comprises an object number configuration describing a number of audio objects to be processed by the signal processor 148, or by the SAOC decoding/transcoding unit 248. The object number configuration also describes a number of object-related parameters included in the object-related parametric information 112, or in the SAOC bitstream 212. The SAOC specific configuration may comprise an object-relationship configuration, which designates objects having a common object-related parametric information. The SAOC specific configuration may also comprise an absolute energy transmission configuration, which indicates whether an absolute energy information is transmitted from an audio encoder to an audio decoder. The SAOC specific configuration may also comprise a downmix channel number configuration, which indicates whether there is only one downmix channel, whether there are two downmix channels, or whether there are, optionally, more than two downmix channels. In addition, the SAOC specific configuration may comprise additional configuration information in some embodiments.

The SAOC specific configuration may also comprise post-processing downmix gain configuration information "bsPdgFlag" which defines whether a post processing downmix gain for an optional post-processing are transmitted.

The SAOC specific configuration also comprises a flag "bsDcuFlag" (which may, for example, be a 1-bit flag), which defines whether the values "bsDcuMode" and "bsDcuParam" are transmitted in the bitstream. If this flag "bsDcuFlag" takes the value of "1", another flag which is marked "bsDcuMandatory" and a flag "bsDcuDynamic" are included in the SAOC specific configuration 310. The flag "bsDcuMandatory" describes whether the distortion control ought to be applied by an audio decoder. If the flag "bsDcuMandatory" is equal to 1, then the distortion control unit ought to be applied using the parameters "bsDcuMode" and "bsDcuParam" as transmitted in the bitstream. If the flag "bsDcuMandatory" is equal to "0", then the distortion control unit parameters "bsDcuMode" and "bsDcuParam" transmitted in the bitstream are only recommended values and also other distortion control unit settings could be used.

In other words, an audio encoder may activate the flag "bsDcuMandatory" in order to enforce the usage of the distortion control mechanism in a standard-compliant audio decoder, and may deactivate said flag in order to leave the decision whether to apply the distortion control unit, and if so, which parameters to use for the distortion control unit, to the audio decoder.

The flag "bsDcuDynamic" enables a dynamic signaling of the values "bsDcuMode" and "bsDcuParam". If the flag "bsDcuDynamic" is deactivated, the parameters "bsDcuMode" and "bsDcuParam" are included in the SAOC specific configuration, and otherwise, the parameters "bsDcuMode" and "bsDcuParam" are included in the SAOC frames, or, at least, in some of the SAOC frames, as will be discussed later on. Accordingly, an audio signal encoder can switch between a one-time signaling (per piece of audio comprising a single SAOC specific configuration and, typically, a plurality of SAOC frames) and a dynamic transmission of said parameters within some or all of the SAOC frames.

The parameter "bsDcuMode" defines the distortion-free target matrix type for the distortion control unit (DCU) according to the table of FIG. 3*d*.

The parameter "bsDcuParam" defines the parameter value for the distortion control unit (DCU) algorithm according to the table of FIG. 3*e*. In other words, the 4-bit parameter "bsDcuParam" defines an index value idx, which can be mapped by an audio signal decoder onto a linear combination value $g_{DCU}$ (also designated with "DcuParam[ind]" or "DcuParam[idx]"). Thus, the parameter "bsDcuParam" represents, in a quantized manner, the linear combination parameter.

As can be seen in FIG. 3*b*, the parameters "bsDcuMandatory", "bsDcuDynamic", "bsDcuMode" and "bsDcuParam" are set to a default value of "0", if the flag "bsDcuFlag" takes the value of "0", which indicates that no distortion control unit parameters are transmitted.

The SAOC specific configuration also comprises, optionally, one or more byte alignment bits "ByteAlign( )" to bring the SAOC specific configuration to a desired length.

In addition, the SAOC specific configuration may optionally comprise a SAOC extension configuration "SAOCExtensionConfig( )", which comprises additional configuration parameters. However, said configuration parameters are not relevant for the present invention, such that a discussion is omitted here for the sake of brevity.

5.2. SAOC Frame Syntax

In the following the syntax of an SAOC frame will be described taking reference to FIG. 3*c*.

The SAOC frame "SAOCFrame" typically comprises encoded object level difference values OLD as discussed before, which may be included in the SAOC frame data for a plurality of frequency bands ("band-wise") and for a plurality of audio objects (per audio object).

The SAOC frame also, optionally, comprises encoded absolute energy values NRG which may be included for a plurality of frequency bands (band-wise).

The SAOC frame may also comprise encoded inter-object correlation values IOC, which are included in the SAOC frame data for a plurality of combinations of audio objects. The IOC values are typically included in a band-wise manner.

The SAOC frame also comprises encoded downmix-gain values DMG, wherein there is typically one downmix gain value per audio object per SAOC frame.

The SAOC frame also comprises, optionally, encoded downmix channel level differences DCLD, wherein there is typically one downmix channel level difference value per audio object and per SAOC frame.

Also, the SAOC frame typically comprises, optionally, encoded post-processing downmix gain values PDG.

In addition, an SAOC frame may also comprise, under some circumstances, one or more distortion control parameters. If the flag "bsDcuFlag", which is included in the SAOC specific configuration section, is equal to "1", indicating usage of distortion control unit information in the bitstream, and if the flag "bsDcuDynamic" in the SAOC specific configuration also takes the value of "1", indicating the usage of a dynamic (frame-wise) distortion control unit information, the distortion control information is included in the SAOC frame, provided that the SAOC frame is a so-called "independent" SAOC frame, for which the flag "bsIndependencyFlag" is active or that the flag "bsDcuDynamicUpdate" is active.

It should be noted here that the flag "bsDcuDynamicUpdate" is only included in the SAOC frame if the flag "bsIndependencyFlag" is inactive and that the flag "bsDcuDynamicUpdate" defines whether the values "bsDcuMode" and "bsDcuParam" are updated. More precisely, "bsDcuDynamicUpdate"==1 means that the values "bsDcuMode" and "bsDcuParam" are updated in the current frame, whereas "bsDcuDynamicUpdate"==0 means that the previously transmitted values are kept.

Accordingly, the parameters "bsDcuMode" and "bsDcuParam", which have been explained above, are included in the SAOC frame if the transmission of distortion control unit parameters is activated and a dynamic transmission of the distortion control unit data is also activated and the flag "bsDcuDynamicUpdate" is activated. In addition, the parameters "bsDcuMode" and "bsDcuParam" are also included in the SAOC frame if the SAOC frame is an "independent" SAOC frame, the transmission of distortion control unit data is activated and the dynamic transmission of distortion control unit data is also activated.

The SAOC frame also comprises, optionally, fill data "byteAlign( )" to fill up the SAOC frame to a desired length.

Optionally, the SAOC frame may comprise additional information, which is designated as "SAOCExt or ExtensionFrame( )". However, this optional additional SAOC frame information is not relevant for the present invention and, for the sake of brevity, will therefore not be discussed here.

For completeness, it should be noted that the flag "bsIndependencyFlag" indicates if lossless coding of the current SAOC frame is done independently of the previous SAOC frame, i.e. whether the current SAOC frame can be decoded without knowledge of the previous SAOC frame.

6. SAOC Decoder/Transcoder According to FIG. 4

In the following, further embodiments of rendering coefficient limiting schemes for distortion control in SAOC will be described.

6.1 Overview

Figure 4:
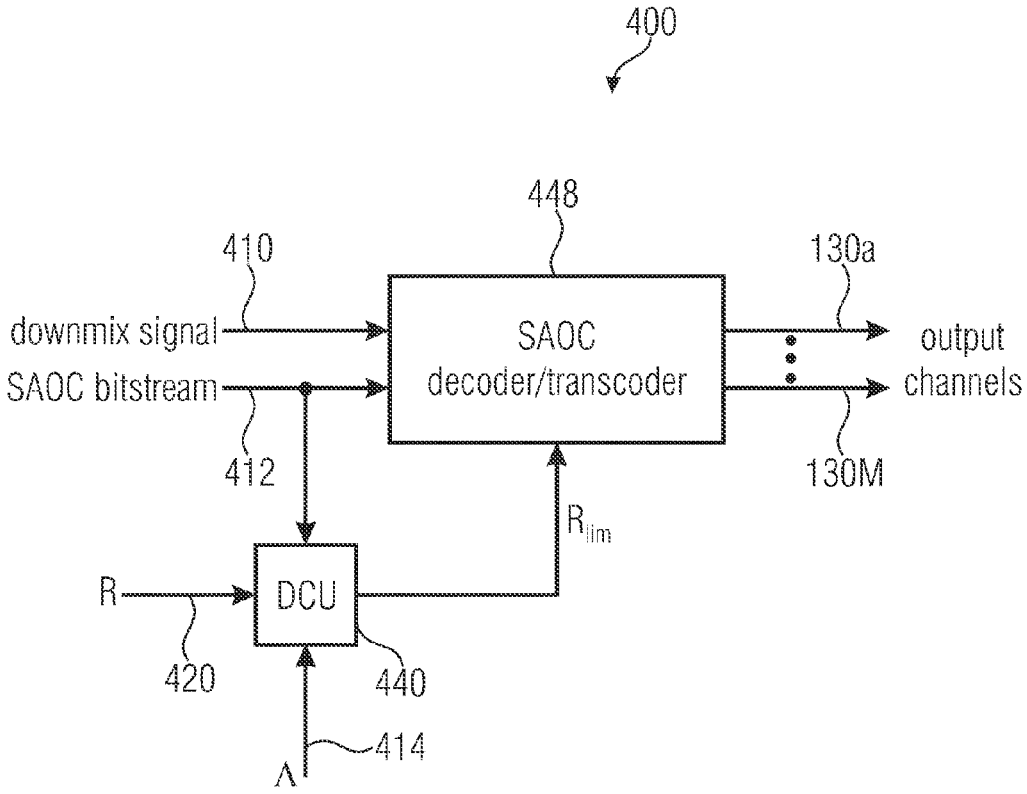
FIG. 4 shows a block schematic diagram of an apparatus for providing an upmix signal representation, according to another embodiment of the invention.

FIG. 4 shows a block schematic diagram of an audio decoder 400, according to an embodiment of the invention.

The audio decoder 400 is configured to receive a downmix signal 410, an SAOC bitstream 412, a linear combination parameter 414 (also designated with A), and a rendering matrix information 420 (also designated with R). The audio decoder 400 is configured to receive an upmix signal representation, for example, in the form of a plurality of output channels 130*a* to 130M. The audio decoder 400 comprises a distortion control unit 440 (also designated with DCU) which receives at least a part of the SAOC bitstream information of the SAOC bitstream 412, the linear combination parameter 414 and the rendering matrix information 420. The distortion control unit provides a modified rendering information $R_{lim}$ which may be a modified rendering matrix information.

The audio decoder 400 also comprises an SAOC decoder and/or SAOC transcoder 448, which receives the downmix signal 410, the SAOC bitstream 412 and the modified rendering information $R_{lim}$ and provides, on the basis thereof, the output channels 130*a* to 130M.

In the following, the functionality of the audio decoder 400, which uses one or more rendering coefficient limiting schemes according to the present invention, will be discussed in detail.

The general SAOC processing is carried out in a time/frequency selective way and can be described as follows. The SAOC encoder (for example, the SAOC encoder 150) extracts the psychoacoustic characteristics (e.g. object power relations and correlations) of several input audio object signals and then downmixes them into a combined mono or stereo channel (for example, the downmix signal 182 or the downmix signal 410). This downmix signal and extracted side information (for example, the object-related parametric side information or the SAOC bitstream information 412 are transmitted (or stored) in compressed format using the well-known perceptual audio coders. On the receiving end, the SAOC decoder 418 conceptually tries to restore the original object signals (i.e. separate downmixed objects) using the transmitted side information 412. These approximated object signals are then mixed into a target scene using a rendering matrix. The rendering matrix for example R or $R_{lim}$, is composed of the Rendering Coefficients (RCs) specified for each transmitted audio object and upmix setup loudspeaker. These RCs determine gains and spatial positions of all separated/rendered objects.

Effectively, the separation of the object signals is rarely or even never executed since the separation and the mixing is performed in a single combined processing step which results in an enormous reduction of computational complexity. This scheme is tremendously efficient, both in terms of transmission bitrate (only needs to transmit one or two downmix channels 182, 410 plus some side information 186, 188, 412, 414, instead of a number of individual object audio signals) and computational complexity (the processing complexity relates mainly to the number of output channels rather than the number of audio objects). The SAOC decoder transforms (on a parametric level) the object gains and other side information directly into the Transcoding Coefficients (TCs) which are applied to the downmix signal 182, 414 to create the corresponding signals 130*a* to 130M for the rendered output audio scene (or preprocessed downmix signal for a further decoding operation, i.e. typically multichannel MPEG Surround rendering).

The subjectively perceived audio quality of the rendered output scene can be improved by application of a distortion control unit DCU (e.g. a rendering matrix modifying unit), as described in [6]. This improvement can be achieved for the price of accepting a moderate dynamic modification of the target rendering settings. The modification of the rendering information can be done time and frequency variant, which under specific circumstances may result in unnatural sound colorations and/or temporal fluctuation artifacts.

Within the overall SAOC system, the DCU can be incorporated into the SAOC decoder/transcoder processing chain in the straightforward way. Namely, it is placed at the front-end of the SAOC by controlling the RCs R, see FIG. 4.

6.2 Underlying Hypothesis

The underlying hypothesis of the indirect control method considers a relationship between distortion level and deviations of the RCs from their corresponding objects' level in the downmix. This is based on the observation that the more specific attenuation/boosting is applied by the RCs to a particular object with respect to the other objects, the more aggressive modification of the transmitted downmix signal is to be performed by the SAOC decoder/transcoder. In other words: the higher the deviation of the "object gain" values are relative to each other, the higher the chance for unacceptable distortion to occur (assuming identical downmix coefficients).

6.3 Calculation of the Limited Rendering Coefficients

Based on the user specified rendering scenario represented by the coefficients (the RCs) of a matrix R of size $N_{ch} \times N_{ob}$ (i.e. the rows correspond to the output channels 130*a* to 130M, the columns to the input audio objects), the DCU prevents extreme rendering settings by producing a modified matrix $R_{lim}$ comprising limited rendering coefficients, which are actually used by the SAOC rendering engine 448. Without loss of generality, in the subsequent description the RCs are assumed to be frequency invariant to simplify the notation. For all operational modes of SAOC the limited rendering coefficients can be derived as $$R_{lim}=(1+\Lambda)R+\Lambda\tilde{R}.$$

This means that by incorporating the cross-fading parameter $\Lambda \epsilon [0,1]$ (also designated as a linear combination parameter), a blending of the (user specified) rendering matrix R towards a target matrix $\tilde{R}$ can be realized. In other words, the limited matrix $R_{lim}$ represents a linear combination of the rendering matrix R and a target matrix. On one hand, the target rendering matrix could be the downmix matrix (i.e. the downmix channels are passed through the transcoder 448) with a normalization factor or another static matrix that results in a static transcoding matrix. This "downmix-similar rendering" ensures that the target rendering matrix does not introduce any SAOC processing artifacts and consequently represents an optimal rendering point in terms of audio quality albeit being totally regardless of the initial rendering coefficients.

However, if an application demands a specific rendering scenario or a user set high value on his/her initial rendering setup (especially, for example, the spatial position of one or more objects), the downmix-similar rendering fails to serve as target point. On the other hand, such a point can be interpreted as "best-effort rendering" when taking into account both the downmix and the initial rendering coefficients (for example, the user specified rendering matrix). The aim of this second definition of the target rendering matrix is to preserve the specified rendering scenario (for example, defined by the user-specified rendering matrix) in a best possible way, but at the same time keeping the audible degradation due to excessive object manipulation on a minimum level.

6.4 Downmix Similar Rendering 6.4.1 Introduction

The downmix matrix D of size $N_{dmx} \times N_{ob}$ is determined by the encoder (for example, the audio encoder 150) and comprises information on how the input objects are linearly combined into the downmix signal which is transmitted to the decoder. For example, with a mono downmix signal, D reduces to a single row vector, and in the stereo downmix case $N_{dmx}=2$.

The "downmix-similar rendering" matrix $R_{DS}$ is computed as $$\tilde{R}(=R_{DS})=N_{DS}D_R,$$

where $N_{DS}$ represents the energy normalization scalar and $D_R$ is the downmix matrix extended by rows of zero elements such that number and order of the rows of $D_R$ correspond to the constellation of R. For example, in the SAOC stereo to multichannel transcoding mode (x-2-5) $N_{dmx}=2$ and $N_{ch}=6$. Accordingly $D_R$ is of size $N_{ch} \times N_{ob}$ and its rows representing the front left and right output channels equal D.

6.4.2 All Decoding/Transcoding SAOC Modes

For all decoding/transcoding SAOC modes the energy normalization scalar $N_{DS}$ can be computed using the following equation $$N_{DS} = \frac{\mathrm{trace}(RR^*) + \varepsilon}{\mathrm{trace}(DD^*) + \varepsilon},$$

where the operator trace(X) implies summation of all diagonal elements of matrix X. The (*) implies the complex conjugate transpose operator.

6.5 Best Effort Rendering 6.5.1 Introduction

The best effort rendering method describes a target rendering matrix, which depends on the downmix and rendering information. The energy normalization is represented by a matrix $N_{BE}$ of size $N_{ch} \times N_{dmx}$, hence it provides individual values for each output channel (provided that there is more than one output channel). This requests different calculations of $N_{BE}$ for the different SAOC operation modes, which are outlined in the subsequent sections.

The "best effort rendering" matrix is computed as $$\tilde{R}(=R_{BE})=N_{BE}D,$$

where D is the downmix matrix and $N_{BE}$ represents the energy normalization matrix.

6.5.2 SAOC Mono-to-Mono ("x-1-1") Decoding Mode

For the "x-1-1" SAOC mode the energy normalization scalar $N_{BE}$ can be computed using the following equation $$N_{BE} = \frac{\sum_{j=1}^{N_{ob}} r_{1,j}^2 + \varepsilon}{\sum_{j=1}^{N_{ob}} d_{1,j}^2 + \varepsilon}.$$

6.5.3 SAOC Mono-to-Stereo ("x-1-2") Decoding Mode

For the "x-1-2" SAOC mode the energy normalization matrix $N_{BE}$ of size 2×1 can be computed using the following equation $$N_{BE} = \begin{bmatrix} \frac{\sum_{j=1}^{N_{ob}} r_{1,j}^2 + \varepsilon}{\sum_{j=1}^{N_{ob}} d_{1,j}^2 + \varepsilon}, & \frac{\sum_{j=1}^{N_{ob}} r_{2,j}^2 + \varepsilon}{\sum_{j=1}^{N_{ob}} d_{1,j}^2 + \varepsilon} \end{bmatrix}^T.$$

6.5.4 SAOC Mono-to-Binaural ("x-1-b") Decoding Mode

For the "x-1-b" SAOC mode the energy normalization matrix $N_{BE}$ of size 2×1 can be computed using the following equation $$N_{BE} = \begin{bmatrix} \frac{\sum_{j=1}^{N_{ob}} r_{1,j}^2 + \varepsilon}{\sum_{j=1}^{N_{ob}} d_{1,j}^2 + \varepsilon}, \ldots, & \frac{\sum_{j=1}^{N_{ob}} r_{2,j}^2 + \varepsilon}{\sum_{j=1}^{N_{ob}} d_{1,j}^2 + \varepsilon} \end{bmatrix}^T.$$

It should be noted further that here $r_1$ and $r_2$ consider/incorporate binaural HRTF parameter information.

It should also be noted that for all 3 equations above, the square root of $N_{BE}$ has to be taken, i.e.

$$\tilde{R}(=R_{BE})=\sqrt{N_{BE}}D$$

(see description before).

6.5.5 SAOC Stereo-to-Mono ("x-2-1") Decoding Mode

For the "x-2-1" SAOC mode the energy normalization matrix $N_{BE}$ of size 1×2 can be computed using the following equation $$N_{BE}=R_1D^*(DD^*)^{-1},$$

where the mono rendering matrix $R_1$ of size $1 \times N_{ob}$ is defined as $$R_1=[r_{1,1} \ldots r_{1,N_{ob}}].$$

6.5.6 SAOC Stereo-to-Stereo ("x-2-2") Decoding Mode

For the "x-2-2" SAOC mode the energy normalization matrix $N_{BE}$ of size 2×2 can be computed using the following equation $$N_{BE}=R_2D^*(DD^*)^{-1},$$

where the stereo rendering matrix $R_2$ of size $2\times N_{ob}$ is defined as $$R_2 = \begin{bmatrix} r_{1,1} & \cdots & r_{1,N_{ob}} \\ r_{2,1} & \cdots & r_{2,N_{ob}} \end{bmatrix}.$$

6.5.7 SAOC Mono-to-Binaural ("x-2-b") Decoding Mode

For the "x-2-b" SAOC mode the energy normalization matrix $N_{BE}$ of size 2×2 can be computed using the following equation $$N_{BE}=R_2D^*(DD^*)^{-1},$$

where the binaural rendering matrix $R_2$ of size $2\times N_{ob}$ is defined as $$R_2 = \begin{bmatrix} r_{1,1} & \cdots & r_{1,N_{ob}} \\ r_{2,1} & \cdots & r_{2,N_{ob}} \end{bmatrix}.$$

It should be noted further that here $r_{1,n}$ and $r_{2,n}$ consider/incorporate binaural HRTF parameter information.

6.5.8 SAOC Mono-to-Multichannel ("x-1-5") Transcoding Mode

For the "x-1-5" SAOC mode the energy normalization matrix $N_{BE}$ of size $N_{ch}\times 1$ can be computed using the following equation $$N_{BE} = \begin{bmatrix} \frac{\sum_{j=1}^{N_{ob}} r_{1,j}^2 + \varepsilon}{\sum_{j=1}^{N_{ob}} d_{1,j}^2 + \varepsilon}, \ldots, \frac{\sum_{j=1}^{N_{ob}} r_{N_{ch},j}^2 + \varepsilon}{\sum_{j=1}^{N_{ob}} d_{N_{ch},j}^2 + \varepsilon} \end{bmatrix}^T.$$

Again, taking the square-root for each element is recommended or even needed in some cases.

6.5.9 SAOC Stereo-to-Multichannel ("x-2-5") Transcoding Mode

For the "x-2-5" SAOC mode the energy normalization matrix $N_{BE}$ of size $N_{ch}\times 2$ can be computed using the following equation $$N_{BE}=RD^*(DD^*)^{-1}.$$

6.5.10 Computation of the $(DD^*)^{-1}$

For the computation of the term $(DD^*)^{-1}$ regularization methods can be applied to prevent ill-posed matrix results.

6.6 Control of the Rendering Coefficient Limiting Schemes 6.6.1 Example of Bitstream Syntax In the following a syntax representation of a SAOC specific configuration will be described taking reference to FIG. 5*a*. The SAOC specific configuration "SAOCSpecificConfig( )" comprises conventional SAOC configuration information. Moreover, the SAOC specific configuration comprises a DCU specific addition 510, which will be described in more detail in the following. The SAOC specific configuration also comprises one or more fill bits "ByteAlign( )", which may be used to adjust the length of the SAOC specific configuration. In addition, the SAOC specific configuration may optionally comprise and SAOC extension configuration, which comprises further configuration parameters.

The DCU specific addition 510 according to FIG. 5*a* to the bitstream syntax element "SAOCSpecificConfig( )" is an example of bitstream signaling for the proposed DCU scheme. This relates to the syntax described in sub-clause "5.1 payloads for SAOC" of the draft SAOC Standard according to reference [8].

In the following, the definition of some of the parameters will be given.

"bsDcuFlag" Defines whether the settings for the DCU are determined by the SAOC encoder or decoder/transcoder. More precisely, "bsDcuFlag"=1 means that the values "bsDcuMode" and "bsDcuParam" specified in the SAOCSpecificConfig( ) by the SAOC encoder are applied to the DCU, whereas "bsDcuFlag"=0 means that the variables "bsDcuMode" and "bsDcuParam" (initialized by the default values) can be further modified by the SAOC decoder/transcoder application or user.

"bsDcuMode" Defines the mode of the DCU. More precisely, "bsDcuMod"=0 means that the "downmix-similar" rendering mode is applied by the DCU, whereas "bsDcuMode"=1 that the "best-effort" rendering mode is applied by the DCU algorithm.

"bsDcuParam" Defines the blending parameter value for the DCU algorithm, wherein the table of FIG. 5*b* shows a quantization table for the "bsDcuParam" parameters.

The possible "bsDcuParam" values are in this example part of a table with 16 entries represented by 4 bits. Of course any table, bigger or smaller, could be used. The spacing between the values can be logarithmic in order to correspond to maximum object separation in decibels. But the values could also be linearly spaced, or a hybrid combination of logarithmic and linear, or any other kind of scale.

The "bsDcuMode" parameter in the bitstream makes it possible for at the encoder side choosing an, for the situation, optimal DCU algorithm. This can be very useful since some applications or content might benefit from the "downmix-similar" rendering mode while other might benefit from the "best-effort" rendering mode.

Typically, the "downmix-similar" rendering mode can be the desired method for applications where backward/forward compatibility is important and the downmix has important artistic qualities that needs to be preserved. On the other hand, the "best-effort" rendering mode can have better performance in cases where this is not the case.

These DCU parameters related to the present invention could of course be conveyed in any other parts of the SAOC bitstream. An alternative location would be using the "SAOCExtensionConfig( )" container where a certain extension ID could be used. Both these sections are located in the SAOC header, assuring minimum data-rate overhead.

Another alternative is to convey the DCU data in the payload data (i.e. in SAOCFrame( )). This would allow for time-variant signaling (for example, signal adaptive control).

A flexible approach is to define bitstream signaling of the DCU data for both header (i.e. static signaling) and in the payload data (i.e. dynamic signaling). Then an SAOC encoder is free to choose one of the two signaling methods.

6.7 Processing Strategy

In the case if the DCU settings (e.g. DCU mode "bsDcuMode" and blending parameter setting "bsDcuParam") are explicitly specified by the SAOC encoder (e.g. "bsDcuFlag"=1), the SAOC decoder/transcoder applies these values directly to the DCU. If the DCU settings are not explicitly specified (e.g. "bsDcuFlag"=0) the SAOC decoder/transcoder uses the default values and allows the SAOC decoder/transcoder application or user to modify them. The first quantization index (e.g. idx=0) can be used for disabling DCU. Alternatively, the DCU default value ("bsDcuParam") can be "0" i.e. disabling the DCU or "1" i.e. full limiting.

7. Performance Evaluation 7.1 Listening Test Design

A subjective listening test has been conducted to assess the perceptual performance of the proposed DCM concept and compare it to the results of the regular SAOC RM decoding/transcoding processing. Compared to other listening tests, the task of this test is to consider best possible reproduction quality in extreme rendering situations ("soloing objects", "muting objects") regarding two quality aspects:

1. achieving the objective of the rendering (good attenuation/boosting of the target objects)
2. overall scene sound quality (considering distortions, artifacts, unnaturalness . . . )

Please note that an unmodified SAOC processing may fulfill aspect #1 but not aspect #2, whereas simply using the transmitted downmix signal may fulfill aspect #2 but not aspect #1.

The listening test was conducted presenting only true choices to the listener, i.e. only material that is truly available as a signal at the decoder side. Thus, the presented signals are the output signal of the regular (unprocessed by the DCU) SAOC decoder, demonstrating the baseline performance of the SAOC and the SAOC/DCU output. In addition, the case of trivial rendering, which corresponds to the downmix signal, is presented in the listening test.

The table of FIG. 6*a* describes the listening test conditions.

Since the proposed DCU operates using the regular SAOC data and downmixes and does not rely on residual information, no core coder has been applied to the corresponding SAOC downmix signals.

7.2 Listening Test Items

The following items together with extreme and critical rendering have been chosen for the current listening test from the CfP listening test material.

The table of FIG. 6*b* describes the audio items of the listening tests.

7.3 Downmix and Rendering Settings

The rendering objects gains which are described in the table of FIG. 6*c* have been applied for the considered upmix scenarios.

7.4 Listening Test Instructions

The subjective listening tests were conducted in an acoustically isolated listening room that is designed to permit high-quality listening. The playback was done using headphones (STAX SR Lambda Pro with Lake-People D/A-Converter and STAX SRM-Monitor).

The test method followed the procedure used in the spatial audio verification tests, similar to the "Multiple Stimulus with Hidden Reference and Anchors" (MUSHRA) method for the subjective assessment of intermediate quality audio [2]. The test method has been modified as described above in order to assess the perceptual performance of the proposed DCU. The listeners were instructed to adhere to the following listening test instructions:

"Application scenario: Imagine you are the user of an interactive music remix system which allows you to make dedicated remixes of music material. The system provides mixing desk style sliders for each instrument to change its level, spatial position, etc.

Due to the nature of the system, some extreme sound mixes can lead to distortion which degrades the overall sound quality. On the other hand, sound mixes with similar instrument levels tend to produce better sound quality.

It is the objective of this test to assess different processing algorithms regarding their impact on sound modification strength and sound quality.

There is no "Reference signal" in this test! Instead of that a description of the desired sound mixes is given below.

For each audio item please:

- first read the description of the desired sound mixes that you as a system user would like to achieve
- Item "BlackCoffee": Soft brass section within the sound mix
- Item "VoiceOverMusic": Soft background music
- Item "Audition": Strong vocal sound and soft music
- Item "LovePop": Soft string section within the sound mix
- then grade the signals using one common grade to describe both
  - achieving the rendering objective of the desired sound mix
  - overall scene sound quality (consider distortions, artifacts, unnaturalness, spatial distortions, . . . )"

A total of 8 listeners participated in each of the performed tests. All subjects can be considered as experienced listeners. The test conditions were randomized automatically for each test item and for each listener. The subjective responses were recorded by a computer-based listening test program on a scale ranging from 0 to 100, with five intervals labeled in the same way as on the MUSHRA scale. An instantaneous switching between the items under test was allowed.

7.5 Listening Test Results

Figure 7:
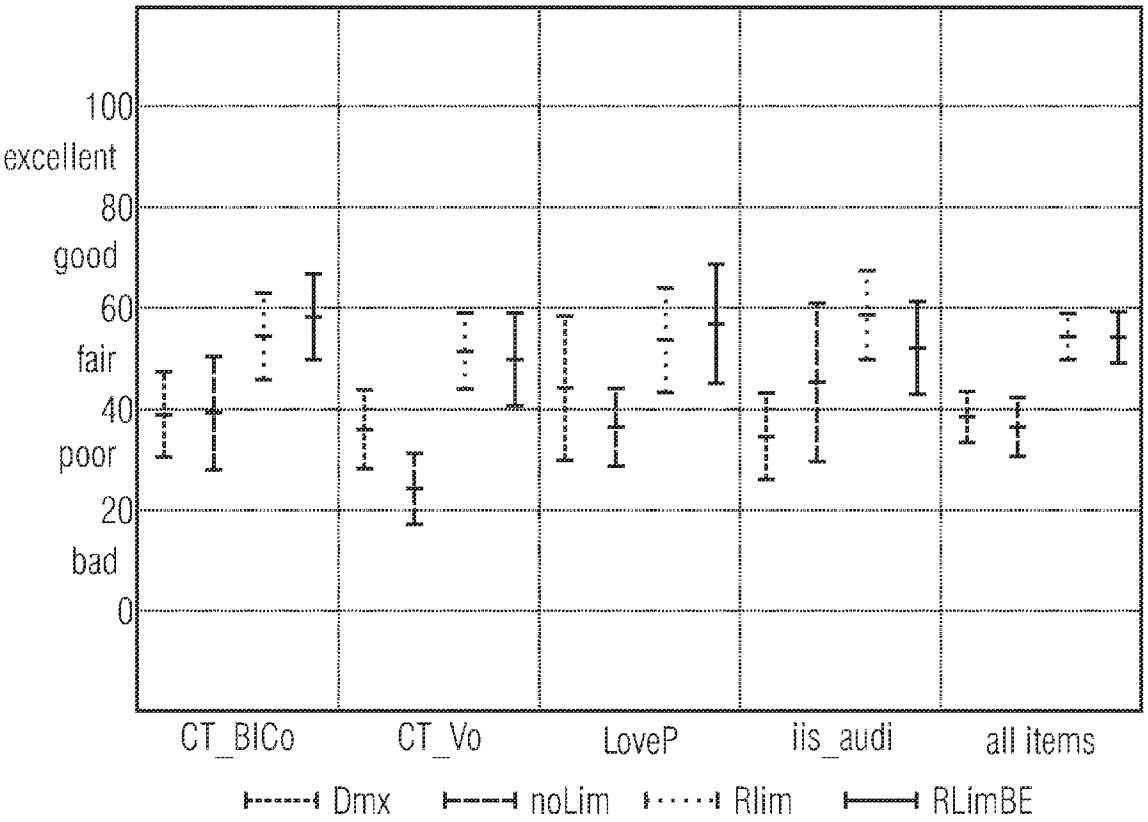
FIG. 7 shows a graphic representation of distortion control unit (DCU) listening test results for a stereo-to-stereo SAOC scenario.

The plots shown in the graphical representation of FIG. 7 show the average score per item over all listeners and the statistical mean value over all evaluated items together with the associated 95% confidence intervals.

The following observations can be made based upon the results of the conducted listening tests: For conducted listening test the obtained MUSHRA scores prove that the proposed DCU functionality provides a significantly better performance in comparison with the regular SAOC RM system in sense of overall statistical mean values. One should note that the quality of all items produced by the regular SAOC decoder (showing strong audio artifacts for the considered extreme rendering conditions) is graded as low as the quality of downmix-identical rendering settings which does not fulfill the desired rendering scenario at all. Hence, it can be concluded that the proposed DCU methods lead to considerable improvement of subjective signal quality for all considered listening test scenarios.

8. Conclusions

To summarize the above discussion, rendering coefficient limiting schemes for distortion control in SAOC have been described. Embodiments according to the invention may be used in combination with parametric techniques for bitrate-efficient transmission/storage of audio scenes containing multiple audio objects, which have recently been proposed (e.g., see references [1], [2], [3], [4] and [5]).

In combination with user interactivity at the receiving side, such techniques may conventionally (without the use of the inventive rendering coefficient limiting schemes) lead to a low quality of the output signals if extreme object rendering is performed (see, for example, reference [6]).

The present specification is focused on Spatial Audio Object Coding (SAOC) which provides means for a user interface for the selection of the desired playback setup (e.g. mono, stereo, 5.1, etc.) and interactive real-time modification of the desired output rendering scene by controlling the rendering matrix according to personal preference or other criteria. However, the invention is also applicable for parametric techniques in general.

Due to the downmix/separation/mix-based parametric approach, the subjective quality of the rendered audio output depends on the rendering parameter settings. The freedom of selecting rendering settings of the user's choice entails the risk of the user selecting inappropriate object rendering options, such as extreme gain manipulations of an object within the overall sound scene.

For a commercial product, it is by all means unacceptable to produce bad sound quality and/or audio artifacts for any settings on the user interface. In order to control excessive deterioration of the produced SAOC audio output, several computational measures have been described which are based on the idea of computing a measure of perceptual quality of the rendered scene, and depending on this measure (and, optionally, other information), modify the actually applied rendering coefficients (see, for example, reference [6]).

The present document describes alternative ideas for safeguarding the subjective sound quality of the rendered SAOC scene for which all processing is carried out entirely within the SAOC decoder/transcoder, and which do not involve the explicit calculation of sophisticated measures of perceived audio quality of the rendered sound scene.

These ideas can thus be implemented in a structurally simple and extremely efficient way within the SAOC decoder/transcoder framework. The proposed Distortion Control Unit (DCU) algorithm aims at limiting input parameters of the SAOC decoder, namely, the rendering coefficients.

To summarize the above, embodiments according to the invention create an audio encoder, an audio decoder, a method of encoding, a method of decoding, and computer programs for encoding or decoding, or encoded audio signals as described above.

9. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] C. Faller and F. Baumgarte, "*Binaural Cue Coding—Part II: Schemes and applications*", IEEE Trans. on Speech and Audio Proc., vol. 11, no. 6, November 2003.

[2] C. Faller, "*Parametric Joint-Coding of Audio Sources*", 120th AES Convention, Paris, 2006, Preprint 6752.

[3] J. Herre, S. Disch, J. Hilpert, O. Hellmuth: "*From SAC To SAOC—Recent Developments in Parametric Coding of Spatial Audio*", 22nd Regional UK AES Conference, Cambridge, UK, April 2007.

[4] J. Engdegård, B. Resch, C. Falch, O. Hellmuth, J. Hilpert, A. Hölzer, L. Terentiev, J. Breebaart, J. Koppens, E. Schuijers and W. Oomen: "*Spatial Audio Object Coding (SAOC)—The Upcoming MPEG Standard on Parametric Object Based Audio Coding*", 124th AES Convention, Amsterdam 2008, Preprint 7377.

[5] ISO/IEC, "MPEG audio technologies—Part 2: Spatial Audio Object Coding (SAOC)," ISO/IEC JTC1/SC29/WG11 (MPEG) FCD 23003-2.

[6] U.S. patent application 61/173,456, METHODS, APPARATUS, AND COMPUTER PROGRAMS FOR DISTORTION AVOIDING AUDIO SIGNAL PROCESSING

[7] EBU Technical recommendation: "*MUSHRA-EBU Method for Subjective Listening Tests of Intermediate Audio Quality*", Doc. B/AIMO22, October 1999.

[8] ISO/IEC JTC1/SC29/WG11 (MPEG), Document N10843, *"Study on ISO/IEC* 23003-2:200*x Spatial Audio Object Coding* (*SAOC*)", 89th MPEG Meeting, London, UK, July 2009

The invention claimed is:

1. An audio processing apparatus for providing an upmix signal representation on the basis of a downmix signal representation and an object-related parametric information, which are comprised in a bitstream representation of an audio content, and in dependence on a user-specified rendering matrix which defines a desired contribution of a plurality of audio objects to one, two or more output audio channels, the apparatus comprising:

a distortion limiter configured to acquire a modified rendering matrix using a linear combination of a user-specified rendering matrix and a distortion-free target rendering matrix in dependence on a linear combination parameter; and a signal processor configured to acquire the upmix signal representation on the basis of the downmix signal representation and the object-related parametric information using the modified rendering matrix;

wherein the apparatus is configured to evaluate a bitstream element representing the linear combination parameter in order to acquire the linear combination parameter.

2. The apparatus according to claim 1, wherein the distortion limiter is configured to acquire the target rendering matrix such that the target rendering matrix is a distortion-free target rendering matrix.

3. The apparatus according to claim 1, wherein the distortion limiter is configured to acquire the modified rendering matrix $M_{ren,lim}^{l,m}$ according to:

$$M_{ren,lim}^{l,m}=(1-g_{DCU})M_{ren}^{l,m}+g_{DCU}M_{ren,tar}^{l,m}$$

wherein $g_{DCU}$ designates the linear combination parameter, a value of which is in an interval [0,1];

wherein $M_{ren}^{l,m}$ designates the user-specified rendering matrix; and wherein $M_{rem,tar}^{l,m}$ designates the target rendering matrix.

4. The apparatus according to claim 1, wherein the distortion limiter is configured to acquire the target rendering matrix such that the target rendering matrix is a downmix—similar target rendering matrix.

5. The apparatus according to claim 1, wherein the distortion limiter is configured to scale an extended downmix matrix using an energy normalization scalar ($\sqrt{N_{DS}^{l}}$), to acquire the target rendering matrix ($M_{ren,tar}$), wherein the extended downmix matrix is an extended version of a downmix matrix, one or more rows of which downmix matrix describe contributions of a plurality of audio object signals to one or more channels of the downmix signal representation, extended by rows of zero elements, such that a number of rows of the extended downmix matrix is identical to a rendering constellation described by the user-specified rendering matrix.

6. The apparatus according to claim 1, wherein the distortion limiter is configured to acquire the target rendering matrix, such that the target rendering matrix is a best-effort target rendering matrix.

7. The apparatus according to claim 1, wherein the distortion limiter is configured to acquire the target rendering matrix, such that the target rendering matrix depends on a downmix matrix and the user specified rendering matrix.

8. The apparatus according to claim 1, wherein the distortion limiter is configured to compute a matrix comprising channel individual energy normalization values for a plurality of output audio channels of the apparatus for providing an upmix signal representation, such that an energy normalization value for a given output audio channel of the apparatus describes, at least approximately, a ratio between a sum of energy rendering values associated with the given output audio channel in the user-specified rendering matrix for a plurality of audio objects and a sum of energy downmix values for the plurality of audio objects; and wherein the distortion limiter is configured to scale a set of downmix values using channel-individual energy normalization value, to acquire a set of rendering values of the target rendering matrix associated with the given output channel.

9. The apparatus according to claim 1, wherein the distortion limiter is configured to compute a matrix comprising channel-individual energy normalization values for a plurality of output audio channels according to:

$$N_{BE}^{l,m}=\left(\frac{\sum_{j=0}^{N-1}(m_{j,0}^{l,m})^2+\varepsilon}{\sum_{j=0}^{N-1}(d_j^l)^2+\varepsilon},\ \frac{\sum_{j=0}^{N-1}(m_{j,1}^{l,m})^2+\varepsilon}{\sum_{j=0}^{N-1}(d_j^l)^2+\varepsilon}\right)^T$$

for the case of a 1-channel downmix signal representation and a 2-channel output signal of the apparatus; or according to:

$$N_{BE}^{l,m}=\left(\frac{\sum_{j=0}^{N-1}a_{j,1}^{l,m}(a_{j,1}^{l,m})^*+\varepsilon}{\sum_{j=0}^{N-1}(d_j^l)^2+\varepsilon},\ \ldots,\ \frac{\sum_{j=0}^{N-1}a_{j,2}^{l,m}(a_{j,2}^{l,m})^*+\varepsilon}{\sum_{j=0}^{N-1}(d_j^l)^2+\varepsilon}\right)^T$$

for the case of a 1-channel downmix signal representation and a binaural-rendered output signal of the apparatus; or according to:

$$N_{BE}^{l,m}=\left(\frac{\sum_{j=0}^{N-1}(m_{j,0}^{l,m})^2+\varepsilon}{\sum_{j=0}^{N-1}(d_j^l)^2+\varepsilon},\ \ldots,\ \frac{\sum_{j=0}^{N-1}(m_{j,N_{MPS}-1}^{l,m})^2+\varepsilon}{\sum_{j=0}^{N-1}(d_j^l)^2+\varepsilon}\right)^T$$

for the case of a 1-channel downmix signal representation and a $N_{MPS}$-channel output signal of the apparatus;

wherein $m_{j,0}^{l,m}$ designates rendering coefficients of the user-specified rendering matrix describing a desired contribution of an audio object comprising object index j to a first output audio channel of the apparatus;

wherein $m_{j,1}^{l,m}$ designates rendering coefficients of the user-specified rendering matrix describing a desired contribution of an audio object comprising object index j to a second output audio channel of the apparatus;

wherein $a_{j,1}^{l,m}$ and $a_{j,2}^{l,m}$ designate the rendering coefficients of the user-specified rendering matrix describing a desired contribution of an audio object comprising object index j to a first and second output audio channel of the apparatus, and taking parametric HRTF information into consideration.

wherein $d_j^I$ designates a downmix coefficient describing a contribution of an audio object comprising an object index j to the downmix signal representation; and wherein $\epsilon$ designates an additive constant to avoid division by zero; and wherein the distortion limiter is configured to compute the target rendering matrix $[M_{ren,tar}^{l}]$ according to:

$$M_{ren,BE}^{l}=M_{ren,tar}^{l}=\sqrt{\sqrt{N_{BE}^{l}}}D^{l},$$

wherein $D^l$ designates a downmix matrix comprising the downmix coefficient $d_j$.

10. The apparatus according to claim 1, wherein the distortion limiter is configured to compute a matrix describing a channel-individual energy normalization for a plurality of output audio channels of the apparatus in dependence on the user-specified rendering matrix, and a downmix matrix D; and wherein the distortion limiter is configured to apply the matrix describing the channel-individual energy normalization to acquire a set of rendering coefficients of the target rendering matrix associated with a given output audio channel of the apparatus as a linear combination of sets of downmix values associated with different channels of the downmix signal representation.

11. The apparatus according to claim 1, wherein the distortion limiter is configured to compute a matrix $N_{BE}^{l,m}$ describing the channel-individual energy normalization for a plurality of output audio channels according to:

$$N_{BE}^{l,m}=M_{rem}^{l,m}(D^l)^*J^l$$

for the case of a 2-channel downmix signal representation and a multi-channel output audio signal of the apparatus;

wherein $M_{rem}^{l,m}$ designates the user-specified rendering matrix describing user-specified, desired contributions of a plurality of audio object signals to the multi-channel output audio signal of the apparatus;

wherein $D^l$ designates a downmix matrix describing contributions of a plurality of audio object signals to the downmix signal representation;

wherein $$J^l=(D^I(D^l)^*)^{-1}; \text{ and}$$

wherein the distortion limiter is configured to compute the target rendering matrix $M_{ren,tar}^{l}$ according to $$M_{ren,BE}^{l}=M_{ren,tar}^{l}=N_{BE}^{l}D^l.$$

12. The apparatus according to claim 1, wherein the distortion limiter is configured to compute a matrix $N_{BE}^{l,m}$ according to $$N_{BE}^{l,m}=M_{ren}^{l,m}(D^l)^*J^l$$

for the case of a 2-channel downmix signal representation and a 1-channel output audio signal of the apparatus, or according to $$N_{BE}^{l,m}=A^{l,m}(D^l)^*J^l$$

for the case of a 2-channel downmix signal representation and a binaurally-rendered output audio signal of the apparatus;

wherein $M_{ren}^{l,m}$ designates the user-specified rendering matrix describing user-specified desired contributions of a plurality of audio object signals to the output signal of the apparatus;

wherein $D^l$ designates a downmix matrix describing contributions of a plurality of audio object signals to the downmix signal representation;

wherein $A^{l,m}$ designates a binaural rendering matrix which is based on the user-specified rendering matrix and parameters of a head-related transfer function.

13. The apparatus according to claim 1, wherein the distortion limiter is configured to compute an energy normalization scalar $N_{BE}^{l,m}$ according to $$N_{BE}^{l,m}=\frac{\sum_{j=0}^{N-1}(m_{j,0}^{l,m})^2+\varepsilon}{\sum_{j=0}^{N-1}(d_j^l)^2+\varepsilon},$$

wherein $m_{j,0}^{l,m}$ designates a rendering coefficient of the user-specified rendering matrix describing a desired contribution of an audio object comprising object index j to an output audio signal of the apparatus;

wherein $d_j$ designates a downmix coefficient describing a contribution of an audio object comprising object index j to the downmix signal representation; and wherein $\epsilon$ designates an additive constant to avoid division by zero.

14. The apparatus according to claim 1, wherein the apparatus is configured to read an index value representing the linear combination parameter from the bitstream representation of the audio content and to map the index value onto the linear combination parameter using a parameter quantization table.

15. The apparatus according to claim 14, wherein the quantization table describes a non-uniform quantization, wherein smaller values of the linear combination parameter, which describe a stronger contribution of the user-specified rendering matrix onto the modified rendering matrix, are quantized with higher resolution.

16. The apparatus according to claim 1, wherein the apparatus is configured to evaluate a bitstream element describing a distortion limitation mode, and wherein the distortion limiter is configured to selectively acquire the target rendering matrix such that the target rendering matrix is a downmix-similar target rendering matrix, or such that the target rendering matrix is a best-effort target rendering matrix.

17. An apparatus for providing a bitstream representing a multi-channel audio signal, the apparatus comprising:

a downmixer configured to provide a downmix signal on the basis of a plurality of audio object signals;

a side information provider configured to provide an object-related parametric side information describing characteristics of the audio object signals and downmix parameters, and a linear combination parameter describing desired contributions of a user-specified rendering matrix and of a target rendering matrix to a modified rendering matrix to be used by an apparatus for providing an upmix signal representation on the basis of the bitstream; and a bitstream formatter configured to provide a bitstream comprising a representation of the downmix signal, of the object-related parametric side information and of the linear combination parameter;

wherein the user-specified rendering matrix defines a desired contribution of a plurality of audio objects to one, two or more output audio channels.

18. An audio processing method for providing an upmix signal representation on the basis of a downmix signal representation and an object-related parametric information, which are comprised in a bitstream representation of an audio content, and in a dependence on a user-specified rendering matrix which defines a desired contribution of a plurality of audio objects to one, two or more output audio channels, the method comprising:

evaluating a bitstream element representing a linear combination parameter, in order to acquire the linear combination parameter;

acquiring a modified rendering matrix using a linear combination of a user-specified rendering matrix and a distortion-free target rendering matrix in dependence on the linear combination parameter; and acquiring the upmix signal representation on the basis of the downmix signal representation and the object-related parametric information using the modified rendering matrix.

19. A method for providing a bitstream representing a multi-channel audio signal, the method comprising:

providing a downmix signal on the basis of a plurality of audio object signals;

providing an object-related parametric side information describing characteristics of the audio object signals and downmix parameters, and a linear combination parameter describing desired contributions of a user-specified rendering matrix and of a target rendering matrix to a modified rendering matrix; and providing a bitstream comprising a representation of the downmix signal, of the object-related parametric side information and the linear combination parameter;

wherein the user-specified rendering matrix defines a desired contribution of a plurality of audio objects to one, two or more output audio channels.

20. A non-transitory computer readable medium including a computer program for performing, when the computer program runs on a computer, an audio processing method for providing an upmix signal representation on the basis of a downmix signal representation and an object-related parametric information, which are comprised in a bitstream representation of an audio content, and in a dependence on a user-specified rendering matrix which defines a desired contribution of a plurality of audio objects to one, two or more output audio channels, the method comprising:

evaluating a bitstream element representing a linear combination parameter, in order to acquire the linear combination parameter;

acquiring a modified rendering matrix using a linear combination of a user-specified rendering matrix and a distortion-free target rendering matrix in dependence on the linear combination parameter; and acquiring the upmix signal representation on the basis of the downmix signal representation and the object-related parametric information using the modified rendering matrix.

21. A non-transitory computer readable medium including a computer program for performing, when the computer program runs on a computer, a method for providing a bitstream representing a multi-channel audio signal, the method comprising:

providing a downmix signal on the basis of a plurality of audio object signals;

providing an object-related parametric side information describing characteristics of the audio object signals and downmix parameters, and a linear combination parameter describing desired contributions of a user-specified rendering matrix and of a target rendering matrix to a modified rendering matrix; and providing a bitstream comprising a representation of the downmix signal, of the object-related parametric side information and the linear combination parameter;

wherein the user-specified rendering matrix defines a desired contribution of a plurality of audio objects to one, two or more output audio channels.

* * * * *

UNITED STATES PATENT AND TRADEMARK OFFICE

CERTIFICATE OF CORRECTION

PATENT NO. : 8,571,877 B2
APPLICATION NO. : 13/475084
DATED : October 29, 2013
INVENTOR(S) : Jonas Engdegard et al.

It is certified that error appears in the above-identified patent and that said Letters Patent is hereby corrected as shown below:

In the Claims

In claim 9, line 25 of column 37, remove the first square root symbol after the second equal symbol.

$$\mathbf{M}^{l}_{\text{ren,BE}} = \mathbf{M}^{l}_{\text{ren,tar}} = \sqrt{\mathbf{N}^{l}_{BE}}\,\mathbf{D}^{l}$$

In claim 11, line 45 of column 37, correct the subscript to the M to read "ren" as opposed to the current "rem"

$$\mathbf{N}^{l,m}_{BE} = \mathbf{M}^{l,m}_{\text{ren}} \left(\mathbf{D}^{l}\right)^{*} \mathbf{J}^{l}$$

In claim 11, line 49 of column 37, correct the subscript to the M to read "ren" as opposed to the current "rem"

wherein $\mathbf{M}^{l,m}_{ren}$ designates the user-specified rendering

Signed and Sealed this
Twenty-third Day of September, 2014

Michelle K. Lee

Michelle K. Lee
*Deputy Director of the United States Patent and Trademark Office*